US010310400B2

(12) United States Patent
Yamada et al.

(10) Patent No.: US 10,310,400 B2
(45) Date of Patent: Jun. 4, 2019

(54) DEVELOPER FOR ELECTROSTATIC LATENT IMAGE

(71) Applicant: Konica Minolta, Inc., Chiyoda-ku, Tokyo (JP)

(72) Inventors: Chiaki Yamada, Ibaraki (JP); Masahiro Anno, Sakai (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/719,988

(22) Filed: May 22, 2015

(65) Prior Publication Data

US 2015/0338756 A1 Nov. 26, 2015

(30) Foreign Application Priority Data

May 26, 2014 (JP) ..... 2014-108388

(51) Int. Cl.
*G03G 9/09* (2006.01)
*G03G 9/13* (2006.01)
*G03G 9/12* (2006.01)

(52) U.S. Cl.
CPC ..... *G03G 9/0904* (2013.01); *G03G 9/091* (2013.01); *G03G 9/092* (2013.01); *G03G 9/0914* (2013.01); *G03G 9/0918* (2013.01); *G03G 9/122* (2013.01); *G03G 9/132* (2013.01)

(58) Field of Classification Search
CPC ..... G03G 9/122; G03G 9/132; G03G 9/091; G03G 9/0904; G03G 9/092; G03G 9/0914
USPC ..... 430/114, 115
See application file for complete search history.

(56) References Cited

U.S. PATENT DOCUMENTS 4,264,697 A 4/1981 Perez et al.
5,622,804 A * 4/1997 Matsuoka ..... G03G 9/12 430/115
2002/0081512 A1* 6/2002 Fujii ..... C08G 73/0633 430/108.22
2006/0194138 A1* 8/2006 Regev ..... G03G 9/122 430/114
2007/0020545 A1* 1/2007 Bossidan ..... G03G 9/09 430/115
2014/0134536 A1* 5/2014 Yamada ..... G03G 9/122 430/114
2014/0134537 A1* 5/2014 Yamada ..... G03G 9/122 430/114
2014/0186764 A1* 7/2014 Yamada ..... G03G 9/12 430/114

FOREIGN PATENT DOCUMENTS

JP 56-11461 A 2/1981
JP 62-39879 A 2/1987
JP 2007-528006 A 10/2007
JP 4858661 B1 * 1/2012 ..... G03G 9/125
WO WO 2005/040934 A1 5/2005
WO WO 2011/158611 A1 12/2011
WO WO 2014124734 A1 * 8/2014 ..... G03G 9/0914

OTHER PUBLICATIONS

Chemical Abstracts Registry # 574-93-6 (2017).*
English language machine translation of JP 4858661 (Jan. 2012).*

* cited by examiner

*Primary Examiner* — Christopher D Rodee
(74) *Attorney, Agent, or Firm* — Buchanan Ingersoll & Rooney PC

(57) ABSTRACT

A developer for electrostatic latent image contains toner particles. The toner particles contain a resin and a coloring agent, and the coloring agent includes a first coloring agent, a second coloring agent, and a third coloring agent. The first coloring agent is carbon black, the second coloring agent is one or more of C. I. Pigment Violet 19 and C. I. Pigment Violet 23, and the third coloring agent is one or more of C. I. Pigment Brown 23 and C. I. Pigment Brown 25. A content of the second coloring agent is not lower than 8 mass % and not higher than 25 mass % with respect to a total amount of the coloring agents.

6 Claims, 3 Drawing Sheets

DEVELOPER FOR ELECTROSTATIC LATENT IMAGE

This application is based on Japanese Patent Application No. 2014-108388 filed with the Japan Patent Office on May 26, 2014, the entire content of which is hereby incorporated by reference.

BACKGROUND OF THE INVENTION

Field of the Invention

The present invention relates to a developer for electrostatic latent image used in an image formation apparatus and the like.

Description of the Related Art

For a developer for electrostatic latent image used in an image formation apparatus of an electrophotography type, carbon black has widely been used as a coloring agent for obtaining a black image. A black hue exhibited by carbon black, however, may be different in tone from an ideal black hue. Japanese National Patent Publication No. 2007-528006 discloses a technique for improving a black hue as compared with a case of use of carbon black alone, by using together carbon black, a blue coloring agent, and a violet coloring agent.

When carbon black, a blue coloring agent, and a violet coloring agent are used together, however, a hue of toner particles tends to have a bluish shade. Therefore, the developer for electrostatic latent image disclosed in Japanese National Patent Publication No. 2007-528006 is yet to be improved in terms of a hue.

Furthermore, carbon black has conductivity. When carbon black is used alone and contained in toner particles at a high concentration, an electrical resistance of toner particles tends to be low and transfer in electrophotographic image formation tends to be dissatisfactory. In order to lower conductivity of toner particles raised by the presence of carbon black, it is effective to lower a content of carbon black by using other coloring agents. The blue coloring agent disclosed in Japanese National Patent Publication No. 2007-528006, however, has a copper phthalocyanine skeleton, and an electrical resistance thereof is low. Therefore, it is difficult to sufficiently lower conductivity of toner particles by using the blue coloring agent together.

In addition, the blue coloring agent disclosed in Japanese National Patent Publication No. 2007-528006 is lower in color strength of black than carbon black. In order to achieve an image density as high as in the case of carbon black alone by using the blue coloring agent together, a total content of added coloring agents should be increased. When the total content of the coloring agents increases, a ratio of a resin relatively lowers and consequently fixability of toner particles lowers.

The present invention was made in view of the problems above, and an object of the present invention is to provide a developer for electrostatic latent image exhibiting a black hue, which satisfies the hue, prevents also dissatisfactory transfer, and is excellent in fixability.

SUMMARY OF THE INVENTION

The present inventors have considered that, in order to solve the problems above, a coloring agent which is relatively high in electrical resistance and high in color strength as a black color and can achieve a neutral black hue should be used together with carbon black. Then, as a result of dedicated studies, the present inventors have found that all of a hue, transferability, and fixability cannot be satisfied simply by using together a coloring agent only satisfying such conditions as a relatively high electrical resistance and relatively high color strength as a black color and that use together of a coloring agent having a bluish shade relative to a hue of carbon black and a coloring agent having a reddish shade relative to the hue of carbon black is effective. Then, the present inventors have conducted further studies based on this finding and completed the present invention.

The present invention is directed to a developer for electrostatic latent image containing toner particles, the toner particles containing a resin and a coloring agent, the coloring agent including a first coloring agent, a second coloring agent, and a third coloring agent, the first coloring agent being carbon black, the second coloring agent being one or more of C. I. Pigment Violet 19 and C. I. Pigment Violet 23, the third coloring agent being one or more of C. I. Pigment Brown 23 and C. I. Pigment Brown 25, and a content of the second coloring agent being not lower than 8 mass % and not higher than 25 mass % with respect to a total amount of the coloring agents.

In the developer for electrostatic latent image, preferably, carbon black is acid carbon black.

Preferably, the developer for electrostatic latent image is a liquid developer in which toner particles are dispersed in an insulating liquid, the resin is a polyester resin, and the polyester resin has an acid value not lower than 5 mg KOH/g and not higher than 40 mg KOH/g.

Preferably, the developer for electrostatic latent image is a liquid developer in which toner particles are dispersed in an insulating liquid, and a content of the coloring agents in the toner particles is not lower than 20 mass % and not higher than 40 mass %.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
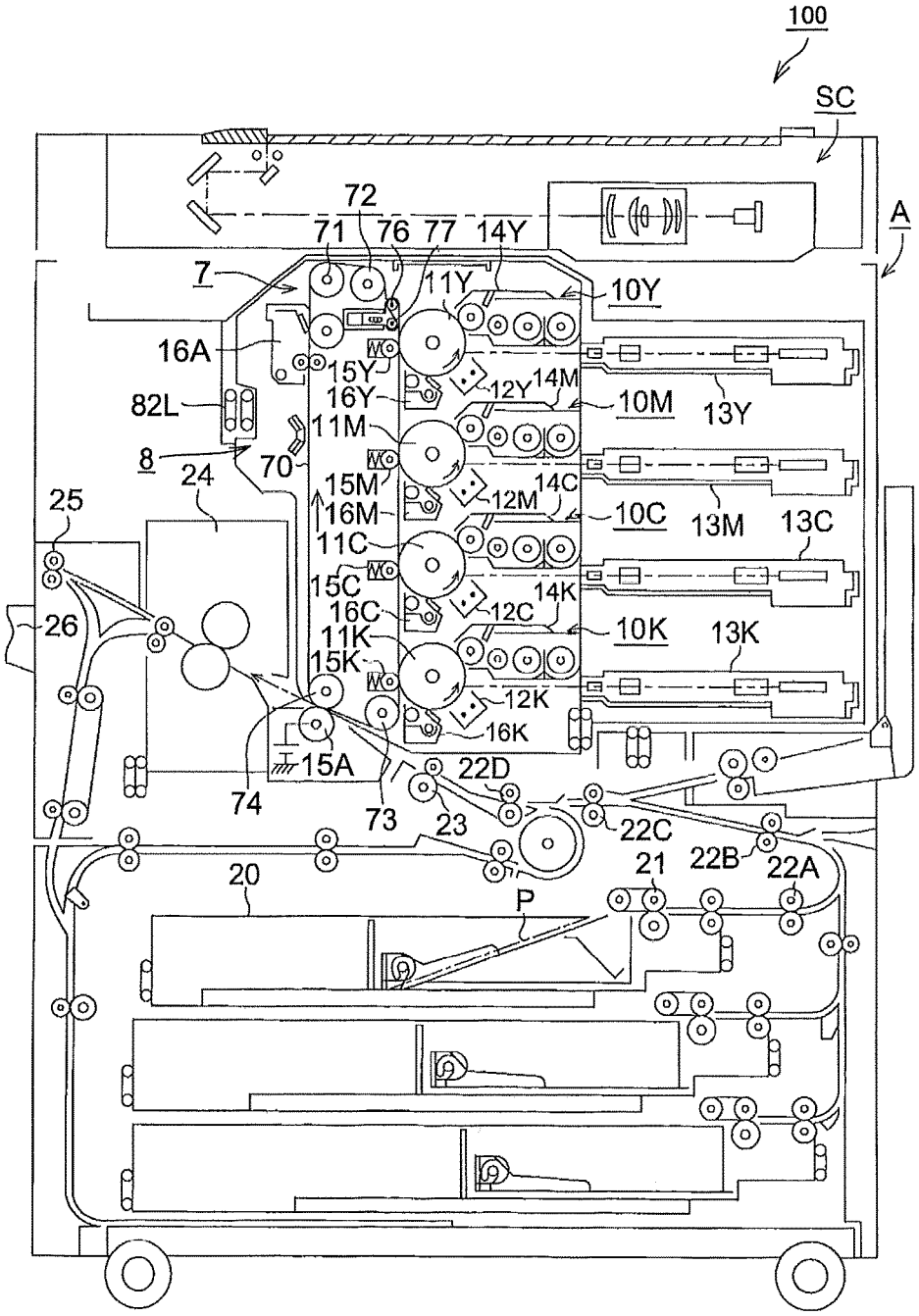
FIG. 1 is a schematic conceptual diagram showing one example of an image formation apparatus of an electrophotography type.

An embodiment according to the present invention will be described below in further detail. In the drawings of the present invention, relation of such a dimension as a length, a width, a thickness, or a depth is modified as appropriate for clarity and brevity of the drawings and does not represent actual dimensional relation.

[Developer for Electrostatic Latent Image]

A developer for electrostatic latent image according to the present embodiment (hereinafter referred to as a "developer") is a dry developer or a liquid developer, and is useful as a developer for electrophotography used in an image formation apparatus of an electrophotography type (which will be described later) such as a copying machine, a printer, a digital printer, or a simple printer, a paint, a developer for electrostatic recording, an oil-based ink for ink jet printer, or an ink for electronic paper.

The dry developer includes a one-component developer and a two-component developer. The one-component developer is made of toner particles and the two-component developer contains toner particles and a carrier. In the two-component developer, the toner particles are constituted of toner base particles and external additive particles. The liquid developer contains toner particles and an insulating liquid (hereinafter also referred to as a "carrier"). Preferably, a content of toner particles in the liquid developer is not lower than 10 mass % and not higher than 50 mass % and a content of an insulating liquid therein is not lower than 50 mass % and not higher than 90 mass %.

Therefore, a dry developer may contain other optional components generally used for a developer so long as the dry developer contains at least toner particles, and a liquid developer may contain other optional components generally used for a developer so long as the liquid developer contains at least toner particles and an insulating liquid. As other optional components generally used for a developer, for example, any conventionally known additive such as a dispersant for coloring agent, a wax, a charge control agent, silica, titanium oxide, or alumina can be contained. Such an optional additive may be contained in toner particles or in a portion other than the toner particles. In a liquid developer, a toner dispersant (which disperses toner particles themselves, instead of a dispersant for coloring agent contained in toner particles) or a thickener can further be contained in an insulating liquid.

"Toner particles" as simply referred to herein refer to toner particles of a liquid developer and toner base particles of a dry developer unless otherwise specified. Herein, toner particles before addition of an external additive may be referred to as "toner base particles" and toner particles after addition of an external additive may be referred to as "external additive added toner particles" for distinction. A mass of toner particles herein refers to a mass of "toner particles" of a liquid developer and a mass of "toner base particles" of a dry developer.

Toner particles, a carrier, and other components contained in a developer will be described below. In connection with toner particles, in addition to a resin and a coloring agent which are essential components to be contained in toner particles, a dispersant for coloring agent, a release agent, and an external additive will also be described.

<Toner Particles>

Toner particles contained in a developer according to the present embodiment contain a resin and a coloring agent. The coloring agent includes a first coloring agent consisting of carbon black, a second coloring agent composed of one or more of C. I. (color index) Pigment Violet 19 and C. I. Pigment Violet 23, and a third coloring agent composed of one or more of C. I. Pigment Brown 23 and C. I. Pigment Brown 25. A content of the second coloring agent is not lower than 8 mass % and not higher than 25 mass % with respect to the total amount of the coloring agents. The coloring agent is dispersed in the resin.

A median diameter D50 of toner particles is not particularly restricted, and preferably, for example, not smaller than 0.5 μm and not greater than 5.0 μm. If a median diameter D50 is smaller than 0.5 μm, toner particles have too small a particle size and hence mobility of toner particles in electric field tends to lower, which may hence lead to lowering in development performance. If a median diameter D50 exceeds 5.0 μm, uniformity in particle size of toner particles tends to lower, which may hence lead to lowering in image quality.

The "median diameter D50 of toner particles" here means a median diameter D50 found through measurement of particle size distribution of toner particles based on volume. A median diameter D50 of toner particles contained in a dry developer can be measured, for example, with a particle size distribution measurement apparatus (a trade name: "Multisizer III" manufactured by Beckman Coulter). A median diameter D50 of toner particles contained in a liquid developer can be measured, for example, with a flow particle image analyzer (a trade name: "FPIA-3000S" manufactured by Sysmex Corporation).

In any case of a dry developer and a liquid developer, toner particles preferably have a core/shell structure. When the toner particles have the core/shell structure, a median diameter D50 of toner particles and circularity of toner particles are readily controlled. As exposure of a coloring agent at surfaces of toner particles is suppressed, resistance to filming can be improved.

The core/shell structure generally refers to such a structure that a resin forming a shell layer (hereinafter also referred to as a "shell resin") covers a surface of a resin forming core particles (hereinafter also referred to as a "core resin"), however, the core/shell structure is not limited to such a structure that a core resin is completely covered with a shell resin. A surface of a core resin may partially be exposed. Though a coloring agent is mostly dispersed in a core resin, the coloring agent may be dispersed in part in a shell resin.

(Coloring Agent)

A coloring agent contained in the developer according to the present embodiment may contain other coloring agents (a coloring agent other than the first coloring agent, the second coloring agent, and the third coloring agent) so long as the coloring agent includes the first coloring agent, the second coloring agent, and the third coloring agent. In the present embodiment, a total amount of the first coloring agent, the second coloring agent, and the third coloring agent is preferably equal to the total amount of coloring agents, that is, the coloring agents contained in the toner particles consist of the first coloring agent, the second coloring agent, and the third coloring agent. In this case, a function and effect which will be described later can more noticeably be exhibited.

The "coloring agent" as simply referred to herein is a comprehensive expression encompassing a coloring agent such as the first coloring agent, the second coloring agent, and the third coloring agent and a dye (an expression expressing all coloring agent components contained in toner particles). A content of coloring agents in toner particles means a content (mass %) of coloring agents with respect to the total amount of toner particles.

(1) First Coloring Agent

The first coloring agent is carbon black. Carbon black is collective denotation of black fine particles mainly composed of carbon. Though carbon black may chemically be categorized as a simple substance of carbon, it can contain various functional groups as is well known. Since carbon black has particularly high color strength among various coloring agents, it is important in obtaining toner particles exhibiting a black color.

A type of carbon black is not particularly limited, and thermal black, acetylene black, channel black, furnace black, lamp black, or aniline black can be exemplified. Preferred specific examples can be exemplified by "#2400", "#2400B", "#2650", "OIL7B", "MA-77", "MA-100", "MA-100S", or "PCF#10" manufactured by Mitsubishi Chemical Corporation, "Black Pearls L", "Mogul L", "MONARCH 1300", "MONARCH 1400", "REGAL 330R", "REGAL 400R", or "MONARCH 1100" manufactured by Cabot Corporation, or "Printex V", "Special Black 4," or "Printex 140V" manufactured by Degussa (an item in " " above representing a trade name).

The first coloring agent is preferably acid carbon black. In this case, with interaction with the second coloring agent and the third coloring agent, dispersibility of each of them is satisfactory. In addition, in this case, dispersibility of carbon black in a resin having a specific acid value which will be described later is also satisfactory. As dispersibility of carbon black is satisfactory, fixability of toner particles is improved. Furthermore, as the second coloring agent and the third coloring agent are located among particles of the first coloring agent consisting of dispersed carbon black, increase in conductivity due to succession of particles of carbon black is suppressed. Satisfactory dispersibility of carbon black is thus advantageous also in improvement in transferability.

Here, acid carbon black refers to such carbon black that a mixture of carbon black and pure water at a ratio of 1:1 is boiled for 5 minutes and cooled to a room temperature and then the slurry mixture has pH of 6 or lower. Such acid carbon black is normally obtained by providing an acid oxygen-containing functional group to a surface of carbon black with such a known method as a wet type surface treatment method and a dry type surface treatment method.

A preferred wet type surface treatment method is exemplified by a method of immersing carbon black in an acid solution such as an acetic acid solution or a sulfonic acid solution. A preferred dry type surface treatment method is exemplified by a method of bringing carbon black in contact with nitric acid, a gas mixture of such an acid gas as nitrogen oxide and air, or an oxidizer such as ozone. An air oxidation method can also be given as an example.

Commercially available acid carbon black can be exemplified, for example, by "MA-100" and "MA-100S" manufactured by Mitsubishi Chemical Corporation and "Mogul L" manufactured by Cabot Corporation.

A content of the first coloring agent is preferably not lower than 40 mass % and not higher than 65 mass % with respect to the total amount of the coloring agents contained in the toner particles. When a content of the first coloring agent with respect to the total amount of the coloring agents is lower than 40 mass %, an image density tends to lower, and when it exceeds 65 mass %, adjustment of an electrical resistance of the toner particles tends to become difficult and transferability tends to be poor. A content of the first coloring agent is more preferably not lower than 45 mass % and not higher than 60 mass % and further preferably not lower than 45 mass % and not higher than 55 mass %. When two or more types of carbon black are employed as the first coloring agent in the present embodiment, the total amount thereof is preferably within the range above.

In the present embodiment, the reason why carbon black can be contained at such a high concentration is because not only carbon black but also both of a specific violet pigment adopted as the second coloring agent and a specific brown pigment adopted as the third coloring agent are added to toner particles, which is the great feature of the present embodiment. This may be because the specific violet pigment which will be described later has a function to improve dispersibility of carbon black and the brown pigment which will be described later relaxes and lowers conductivity of carbon black.

(2) Second Coloring Agent

The second coloring agent is a violet pigment composed of one or more of C. I. Pigment Violet 19 and C. I. Pigment Violet 23. This specific violet pigment has high color strength and a hue thereof is close to black. In addition, the specific violet pigment can exhibit a function like an aid to improve dispersibility of carbon black.

Commercially available C. I. Pigment Violet 19 can be exemplified by "Cromophtal® Violet D 5800" and "Cinquasia Violet K 5350FP" manufactured by Clariant Japan K. K. and "QUINDO Violet 19 228-1119" manufactured by DIC Corporation. Commercially available C. I. Pigment Violet 23 can be exemplified by "FASTOGEN Super Violet RZS" manufactured by DIC Corporation and "LIONOGEN VIOLET FG6141G" manufactured by Toyo Color Co., Ltd. (an item in " " indicating a trade name).

When acid carbon black is employed as the first coloring agent, dispersibility of C. I. Pigment Violet 19 and C. I. Pigment Violet 23 is satisfactory and dispersibility of carbon black is also satisfactory. Since dispersibility of both of the first coloring agent and the second coloring agent is satisfactory, the second coloring agent can be located among dispersed carbon black particles, and consequently increase in conductivity due to succession of carbon black particles can be suppressed. Even when a content of the coloring agents in toner particles is set to be higher than in a conventional example, sufficient fixability can be maintained.

Though the reason why dispersibility of C. I. Pigment Violet 19 and C. I. Pigment Violet 23 is satisfactory when acid carbon black is employed as the first coloring agent is not clear, it may be because C. I. Pigment Violet 19 and C. I. Pigment Violet 23 have an electron donating group and hence dispersibility thereof may improve owing to interaction with acid carbon black.

A content of the second coloring agent is not lower than 8 mass % and not higher than 25 mass % with respect to the total amount of the coloring agents contained in the toner particles. Though the reason why the effect described above cannot be obtained when a content of the second coloring agent with respect to the total amount of the coloring agents is out of the range above is unclear, it may be because balance among a hue, conductivity, dispersibility, and the total amount of coloring agents is lost and consequently all of a hue, transferability, and fixability of a developer cannot be satisfied when the content of the second coloring agent with respect to the total amount of the coloring agents is out of the range above.

When the content of the second coloring agent with respect to the total amount of the coloring agents is lower than 8 mass %, in particular adjustment of color reproducibility tends to be insufficient and transfer characteristics particularly tend to lower. When the content of the second coloring agent exceeds 25 mass %, a hue tends to have a bluish shade. The content of the second coloring agent with respect to the total amount of the coloring agents is more preferably not lower than 15 mass % and not higher than 20 mass %. When the two types of violet pigments above are employed as the second coloring agent, the total amount thereof is preferably within the range above.

(3) Third Coloring Agent

The third coloring agent is a brown pigment composed of one or more of C. I. Pigment Brown 23 and C. I. Pigment Brown 25. This specific brown pigment has high color strength and a hue thereof is close to black. In addition, since the specific brown pigment has a high electrical resistance, it can relax and lower conductivity of carbon black.

Commercially available C. I. Pigment Brown 23 can be exemplified by "Cromophtal® Brown 5R" manufactured by BASF and commercially available C. I. Pigment Brown 25 can be exemplified by "PV Fast Brown HFR" manufactured by Clariant Japan K. K.

When acid carbon black is employed as the first coloring agent, dispersibility of C. I. Pigment Brown 23 and C. I. Pigment Brown 25 is satisfactory and dispersibility of acid carbon black is also satisfactory. As dispersibility of both of the first coloring agent and the third coloring agent is thus satisfactory, the third coloring agent can be located among dispersed carbon black particles and consequently increase in conductivity due to succession of carbon black particles is suppressed. Even when a content of the coloring agents in toner particles is set to be higher than in a conventional example, sufficient fixability can be maintained.

Though the reason why dispersibility of C. I. Pigment Brown 23 and C. I. Pigment Brown 25 is satisfactory when acid carbon black is employed as the first coloring agent is not clear, it may be because C. I. Pigment Brown 23 and C. I. Pigment Brown 25 have an electron donating group and hence dispersibility thereof may improve owing to interaction with acid carbon black.

A content of the third coloring agent is preferably not lower than 20 mass % and not higher than 40 mass % with respect to the total amount of the coloring agents contained in the toner particles. When the content of the third coloring agent with respect to the total amount of the coloring agents is lower than 20 mass %, adjustment of (lowering in) an electrical resistance of the toner particles tends to be insufficient and transfer characteristics tend to lower, and when it exceeds 40 mass %, a hue of the toner particles is close to a hue of a brown pigment and a desired black hue does not tend to be obtained. The content of the third coloring agent with respect to the total amount of the coloring agents is more preferably not lower than 24 mass % and not higher than 35 mass %. When the two types of brown pigments above are employed as the third coloring agent, the total amount thereof is preferably within the range above.

(4) Other Coloring Agents

Toner particles according to the present embodiment may contain coloring agents other than the first coloring agent, the second coloring agent, and the third coloring agent. Other coloring agents can be exemplified by C. I. Pigment Blue 15:3, C. I. Pigment Blue 15:4, C. I. Pigment Yellow 74, C. I. Pigment Yellow 155, C. I. Pigment Yellow 180, C. I. Pigment Yellow 185, C. I. Pigment Red 48:1, C. I. Pigment Red 53:1, C. I. Pigment Red 57:1, C. I. Pigment Red 5, C. I. Pigment Red 269, C. I. Pigment Red 122, and C. I. Pigment Red 209. The coloring agent contained in the toner particles according to the present embodiment preferably consists of the first coloring agent, the second coloring agent, and the third coloring agent. In this case, a function and effect which will be described later can more noticeably be exhibited.

The coloring agent described in detail in (1) to (4) above has a median diameter D50 preferably not greater than 200 μm and more preferably not greater than 150 μm. When the coloring agent has a particle size exceeding 200 μm, a color value of an image may deviate and a desired color may not be obtained. In addition, since dispersibility of the coloring agent in a resin tends to lower, a desired image density may not be obtained or fixability may lower. A lower limit value for a particle size of the coloring agent is not particularly limited, and can be set to a lower limit value of a size of a particle which can be manufactured. A median diameter D50 of the coloring agent can be measured with an ultrasonic particle size distribution and zeta potential measurement apparatus (a trade name: "DT1200" manufactured by Dispersion Technology Inc.).

When a developer is a dry developer, the total amount of the coloring agents in the toner particles is preferably not lower than 8 mass % and not higher than 30 mass % and more preferably not lower than 10 mass % and not higher than 20 mass %. As the total amount of the coloring agents is not lower than 8 mass % in the toner particles of the dry developer, an appropriate image density is obtained even with a small amount of adhesion not more than approximately 4.5 g/m$^2$. When the total amount of the coloring agents in the toner particles exceeds 30 mass %, a content of a resin in the toner particles lowers and sufficient fixation strength does not tend to be obtained.

On the other hand, when a developer is a liquid developer, the total amount of the coloring agents in the toner particles is preferably not lower than 20 mass % and not higher than 40 mass % and more preferably not lower than 25 mass % and not higher than 35 mass %. As the total amount of the coloring agents is not lower than 20 mass % in the toner particles of the liquid developer, an appropriate image density is obtained even with a small amount of adhesion not more than approximately 1.5 g/m$^2$. When the total amount of the coloring agents in the toner particles exceeds 40 mass %, a content of a resin in the toner particles lowers and sufficient fixation strength does not tend to be obtained.

According to the developer in the present embodiment, the toner particles contain the second coloring agent and the third coloring agent together with the first coloring agent, so that lowering in fixability or dissatisfactory transfer can sufficiently be prevented even though the total amount of the coloring agents in the toner particles is designed to be high as described above.

(Resin)

A resin contained in the developer according to the present embodiment has a function to bond the coloring agents to one another and to fix the bonded coloring agent onto a recording medium, and a conventionally known resin can be employed as a resin to be used for such applications without being particularly limited. For example, a polyester resin, an acrylic resin, a styrene acrylic based copolymer resin, a urethane resin, a vinyl chloride resin, a vinyl acetate resin, an epoxy resin, an amide resin, a melamine resin, a phenol resin, an aniline resin, a urea resin, a silicon resin, an imide resin, and the like can be exemplified.

Among them, a polyester resin having sharp melting capability is preferably employed. The polyester resin can vary each characteristic such as a thermal characteristic over a wide range and is excellent in translucency, ductility, and viscoelasticity. Thus, since the polyester resin is excellent in translucency, a beautiful color can be obtained in obtaining a color image. Since the polyester resin is excellent in ductility and viscoelasticity, an image (a resin film) formed on a recording medium such as paper is tough and can strongly adhere to that recording medium.

The polyester resin has a number average molecular weight (Mn) preferably not smaller than 500 and not greater than 5000 and more preferably not smaller than 500 and not greater than 3500. When the number average molecular weight is smaller than 500, uniform dispersion with a coloring agent may be difficult. When the number average molecular weight exceeds 5000, energy required at the time of fixation to a recording medium is great, which may not be preferred. Mn of a resin can be measured with gel permeation chromatography (GPC).

Preferably, the polyester resin is thermoplastic and has a glass transition point (Tg) preferably not lower than 60° C. and not higher than 85° C. When the glass transition point is lower than 60° C., storage stability may be poor. When the glass transition point exceeds 85° C., energy for fixing an image significantly increases, which is not only economically disadvantageous but also likely to apply thermal damage to each portion of an image formation apparatus, and gloss of an image may lower in a case of a low fixation temperature. A more preferred glass transition point is not lower than 60° C. and not higher than 75° C. In the present embodiment, a glass transition point of a resin is measured with a differential scanning calorimeter "DSC-6200" (manufactured by Seiko Instruments, Inc.).

Such a polyester resin can be obtained with a known method such as polycondensation between polyalcohol and polybasic acid (typically polycarboxylic acid).

Polyalcohol is not particularly limited, and for example, alkylene glycol (aliphatic glycol) such as ethylene glycol, diethylene glycol, triethylene glycol, propylene glycol such as 1,2-propylene glycol, dipropylene glycol, butanediol such as 1,4-butanediol, neopentyl glycol, and hexanediol such as 1,6-hexanediol and an adduct of alkylene oxide thereof, bisphenols such as bisphenol A and hydrogenated bisphenol and an adduct of alkylene oxide thereof, alicyclic and aromatic diol such as monocyclic or polycyclic diol, and triol such as glycerin and trimethylolpropane are given as examples, and one of them alone can be employed or two or more of them can be employed as being mixed. In particular, an adduct obtained by adding 2 to 3 moles of alkylene oxide to bisphenol A is suitable as a resin for toner particles of a developer in terms of solubility and stability of a polyester resin which is a product, and it is preferred also in terms of low cost. Alkylene oxide is exemplified by ethylene oxide and propylene oxide.

Polybasic acid (polycarboxylic acid) is exemplified, for example, by saturated or unsaturated (or aromatic) dibasic acid such as malonic acid, succinic acid, adipic acid, azelaic acid, sebacic acid, fumaric acid, maleic acid, itaconic acid, phthalic acid and a modified acid thereof (for example, hexahydrophthalic anhydride), isophthalic acid, and terephthalic acid and an acid anhydride thereof, tribasic acid such as trimellitic acid, trimesic acid, pyromellitic acid and an acid anhydride thereof, and methyl nadic acid, and lower alkyl ester, and one of them alone can be employed or two or more of them can be employed as being mixed. Among them, isophthalic acid, terephthalic acid, and trimellitic acid are suitable for a resin for toner particles of a developer in terms of solubility and stability of a polyester resin which is a product, and they are preferred also in terms of low cost.

The polyester resin has an acid value preferably not lower than 5 mg KOH/g and not higher than 40 mg KOH/g. When a polyester resin having such a specific acid value is contained in toner particles, dispersibility of the second coloring agent and the third coloring agent is better. This may be because the second coloring agent and the third coloring agent have an electron donating group as described above and hence dispersibility improves with interaction with a polyester resin having a specific acid value. The acid value is more preferably not lower than 10 mg KOH/g and not higher than 20 mg KOH/g.

When the polyester resin having a specific acid value as above is employed, such a function as less likeliness of entry of an insulating liquid into the resin, less likeliness of swelling of the resin, and suppression of aggregation of toner particles can also be exhibited. An acid value of the polyester resin is measured under conditions defined under JIS K5400.

The polyester resin having a specific acid value can be manufactured by using polybasic acid having three or more functional groups as a monomer of polybasic acid. Specifically, a part of polybasic acid is provided as polybasic acid having three or more functional groups, so that unreacted carboxylic acid remains in polyester during polycondensation reaction and thus the specific acid value above can be expressed.

One of the resins described above can be employed alone or two or more of them can be employed as being combined, and the resin may form a core/shell structure. When the resin contained in the toner particles forms the core/shell structure, normally, the toner particles as a whole form the core/shell structure. In this case, the coloring agent may be contained in any of a core portion and a shell portion, or may be contained in both of the core portion and the shell portion. As the toner particles have the core/shell structure, a median diameter of the toner particles and circularity of the toner particles are readily controlled.

(Dispersant for Coloring Agent)

In the toner particles according to the present embodiment, the first coloring agent, the second coloring agent, and the third coloring agent coexist as described above, so that dispersibility of the coloring agents is improved and fixability thereof becomes appropriate. In order to further uniformly disperse the coloring agents, any of a dry developer and a liquid developer can contain a dispersant for coloring agent as an optional component. Among others, a basic dispersant composed of a basic polymer is preferred, because a basic dispersant readily uniformly disperses a coloring agent in toner particles in a stable manner.

Here, the basic dispersant refers to a dispersant defined below. Namely, 0.5 g of a dispersant for coloring agent and 20 ml of distilled water are introduced in a screw bottle made of glass, the screw bottle is shaken for 30 minutes with the use of a paint shaker, and the resultant product is filtered. pH of a filtrate obtained through filtration is measured with a pH meter (a trade name: "D-51" manufactured by Horiba, Ltd.), and a filtrate of which pH is higher than 7 is defined as a basic dispersant. It is noted that a filtrate of which pH is lower than 7 is referred to as an acid dispersant.

Such a basic dispersant can be exemplified, for example, by a compound (dispersant for coloring agent) having a functional group such as an amine group, an amino group, an amide group, a pyrrolidone group, an imine group, or a urethane group in a molecule of the dispersant for coloring agent. It is noted that what is called a surfactant having a hydrophilic portion and a hydrophobic portion in a molecule normally falls under the dispersant for coloring agent, however, various compounds can be employed, so long as they have a function to disperse a coloring agent.

A commercially available product of a basic dispersant can be exemplified, for example, by "Ajisper PB-821", "Ajisper PB-822", or "Ajisper PB-881", manufactured by Ajinomoto Fine-Techno Co., Inc., or "Solsperse 32000", "Solsperse 32500", "Solsperse 35100", "Solsperse 37500", or "Solsperse 71000" manufactured by Japan Lubrizol Limited (an item in " " representing a trade name).

An amount of addition of the dispersant for coloring agent described above is preferably not lower than 1 mass % and not higher than 100 mass % and more preferably not lower than 1 mass % and not higher than 40 mass % with respect to the total amount of the coloring agents. When the amount of addition is lower than 1 mass %, dispersibility of the coloring agent may be insufficient. Then, necessary ID (image density) cannot be achieved in some cases and transferability and fixation strength may be lowered. When an amount of addition exceeds 100 mass %, the dispersant for coloring agent in an amount more than necessary for dispersing the coloring agent is added, which may adversely affect chargeability or fixation strength of toner particles.

(Release Agent)

The toner particles according to the present embodiment can contain a release agent as an optional component in a case of a dry developer. A wax can preferably be used as a release agent, and for example, a polyolefin based wax such as a polyethylene wax and a polypropylene wax; a long-chain hydrocarbon based wax such as a paraffin wax and sasolwax; a dialkyl ketone based wax such as distearyl ketone; an ester based wax such as a carnauba wax, a montan wax, trimethylolpropane tribehenate, pentaerythritol tetramyristate, pentaerythritol tetrastearate, pentaerythritol tetrabehenate, pentaerythritol diacetate dibehenate, glycerin tribehenate, 1,18-octadecanediol distearate, tristearyl trimellitate, and distearyl maleate; and an amide based wax such as ethylenediamine dibehenyl amide and trimellitic acid tristearylamide are given as examples.

A wax has a melting point normally from 40 to 125° C., preferably from 50 to 120° C., and more preferably from 60 to 90° C. By setting the melting point within the range above, heat-resistant storage capability of toner particles is ensured and stable image formation can be achieved without causing cold offset or the like even in a case of fixation at a low temperature. A content of a wax in toner particles is preferably not lower than 1 mass % and not higher than 30 mass % and more preferably not lower than 5 mass % and not higher than 20 mass %.

(External Additive)

When the developer according to the present embodiment is a dry developer, toner particles which are toner base particles can contain an external additive as an optional component. An external additive has a function to improve fluidity of toner particles of a dry developer.

A known external additive can be employed as the external additive, and particles of inorganic oxide such as silica, titanium oxide, aluminum oxide, zinc oxide, or tin oxide can suitably be employed. Such an external additive is preferably subjected to hydrophobization treatment. An amount of addition of the external additive is preferably not less than 0.1 part by mass and not more than 10 parts by mass with respect to 100 parts by mass of the toner particles. When the amount of addition is less than 0.1 part by mass, a desired effect is insufficient, and when the amount of addition exceeds 10 parts by mass, lowering in fluidity of the toner particles tends to occur. One or two or more of external additives may be employed.

<Carrier>

The developer according to the present embodiment can contain a carrier in addition to the toner particles described above.

When a developer is a dry developer, a type of a carrier is not particularly restricted, and a known carrier used for a dry developer such as a resin-coated carrier described, for example, in Japanese Laid-Open Patent Publication No. 62-039879 or Japanese Laid-Open Patent Publication No. 56-011461 can suitably be employed.

Here, the resin-coated carrier has such a structure that a resin layer is formed on a surface of a particulate core material, and with such a structure, good capability to charge toner particles can be expressed in a stable manner.

A material for forming a core material is exemplified by a magnetic metal such as iron oxide, nickel, and cobalt and a magnetic oxide such as ferrite and magnetite, and in particular, ferrite and magnetite are preferred. Ferrite containing such a heavy metal as copper, zinc, nickel, and manganese or light metal ferrite containing an alkali metal and/or an alkaline earth metal is preferred as ferrite.

A material forming a resin layer can be exemplified by a polyolefin based resin, a polyvinyl and polyvinylidene based resin, a copolymer, a silicone resin or a modified resin thereof formed by an organosiloxane bond, a fluororesin, a polyamide resin, a polyester resin, a polyurethane resin, a polycarbonate resin, an amino resin, and an epoxy resin. In particular, a material of an alkyl methacrylate base and having an alkyl group branched to a secondary or tertiary alkyl group is suitable in its ability to achieve an appropriate water content and to keep high charge retention capability.

A specific compound includes 2-ethyl hexyl methacrylate, isobutyl methacrylate, cyclopropyl methacrylate, cyclobutyl methacrylate, cyclopentyl methacrylate, cyclohexyl methacrylate, and cycloheptyl methacrylate, and among these, cyclohexyl methacrylate is particularly preferred. When such a compound is employed, charging capability and a glass transition point of a resin layer can be accommodated in a more proper range.

The resin-coated carrier has a median diameter D50 preferably not smaller than 25 μm and not greater than 50 μm. One or two or more of the resin-coated carriers may be employed.

In a case where the developer is a liquid developer, an insulating liquid is employed as a carrier. A carrier is an essential component of a liquid developer. An insulating liquid is preferably a solvent having a resistance value to such an extent as not disturbing an electrostatic latent image (approximately from $10^{11}$ to $10^{16}$ Ω·cm) and being low in odor and toxicity.

A specific compound can generally be exemplified by aliphatic hydrocarbon, cycloaliphatic hydrocarbon, aromatic hydrocarbon, halogenated hydrocarbon, or polysiloxane, and in terms of odor, toxicity, and cost, a normal paraffin based solvent or an isoparaffin based solvent is preferably employed.

For example, "Moresco White" manufactured by Matsumura Oil Research Corp., "Isopar" manufactured by ExxonMobil, "Shellsol" manufactured by Shell Sekiyu K.K., and "IP Solvent 1620" and "IP Solvent 2028" manufactured by Idemitsu Petrochemical Co., Ltd. can be given as examples (an item in " " indicating a trade name). One of these may be employed alone or two or more of them may be employed together.

<Other Optional Components>

The developer according to the present embodiment in the case of a liquid developer may contain a toner dispersant as an optional component other than the toner particles and the carrier described above. A toner dispersant has a function to disperse toner particles in an insulating liquid in a stable manner, and hence it normally exists at (adsorbs to) a surface portion of the toner particles. Such a toner dispersant is preferably soluble in an insulating liquid, and for example, a surfactant or a polymer dispersant can be employed.

Among others, in terms of relation with a resin forming toner particles, a basic polymer dispersant is preferably employed as the toner dispersant. This may be because use of a basic polymer dispersant in a case that a polyester resin forming the toner particles has a high acid value (for example, not lower than 5 mg KOH/g) stabilizes good dispersibility of the toner particles for a long period of time owing to interaction between the polyester resin and the basic polymer dispersant.

A commercially available product of a toner dispersant can be exemplified, for example, by "Ajisper PB-821", "Ajisper PB-822", or "Ajisper PB-881" manufactured by Ajinomoto Fine-Techno Co., Inc., or "Solsperse 28000", "Solsperse 32000", "Solsperse 32500", "Solsperse 35100", "Solsperse 37500", or "Solsperse 71000" manufactured by Japan Lubrizol Limited (an item in " " representing a trade name).

[Function and Effect of Developer for Electrostatic Latent Image]

The toner particles contained in the developer according to the present embodiment contain a resin and a coloring agent. The coloring agent includes the first coloring agent consisting of carbon black, the second coloring agent composed of one or more of C. I. Pigment Violet 19 and C. I. Pigment Violet 23, and the third coloring agent composed of one or more of C. I. Pigment Brown 23 and C. I. Pigment Brown 25. A content of the second coloring agent is not lower than 8 mass % and not higher than 25 mass % with respect to the total amount of the coloring agents.

According to the developer containing the toner particles as described above, a hue is satisfied, dissatisfactory transfer is also prevented, and fixability can be excellent, which will be described as compared with a conventional developer.

For example, with a conventional developer containing only carbon black as a coloring agent (hereinafter also referred to as a "developer A"), an electrical resistance of carbon black is low and hence chargeability of toner particles is impaired and dissatisfactory transfer may occur. In particular, in order to meet a demand for high image quality and low cost, it has been required to realize a high image density with increase in ratio of a coloring agent to be contained in toner particles and with a smaller amount of adhesion of toner. It is actually difficult, however, to realize this with developer A, owing to trade-off for a frequency of occurrence of dissatisfactory transfer as above.

In connection with a developer in which carbon black, a blue coloring agent, and a violet coloring agent (hereinafter also referred to as a "developer B") as disclosed, for example, in Japanese National Patent Publication No. 2007-528006, an electrical resistance of a blue pigment is relatively low. Therefore, with developer B as well, it is difficult to sufficiently lower conductivity of toner particles owing to carbon black and hence dissatisfactory transfer attributed to conductivity cannot sufficiently be prevented.

In addition, the blue coloring agent is lower in black color strength than carbon black. Therefore, in order to realize, with the use of the blue coloring agent together, an image density as high as in the case of carbon black alone, a content of a coloring agent to be added should be increased. Such increase, however, leads to relative lowering in ratio of a resin, and consequently fixability of toner particles lowers.

A "hue" of toner particles can be represented by each value of the L* axis, the a* axis, and the b* axis in the uniform color space of the L*a*b* colorimetric system defined under JIS Z 8729. An ideal hue of a black image can be exemplified by a hue shown in Japan Color Color Reproduction Printing 2001 defined as the color standard for offset sheet-fed printing (type of paper: coated paper, manner: a site attaining a black dot area ratio of 100%). In general, an allowable color difference is presented as $\Delta E<6$ and more preferably as $\Delta E<3$. $\Delta E$ represents a color difference between a certain color and another color in the uniform color space of the L*a*b* colorimetric system defined under JIS Z 8729 and expressed as a square root of the sum of squares of differences on the L* axis, the a* axis, and the b* axis.

In connection with the hue as described above, the present inventors have found that use of carbon black, a blue coloring agent, and a violet coloring agent together tends to lead to a hue having a bluish shade. Therefore, when a content of the blue coloring agent and the violet coloring agent is increased in developer B, the hue has a further bluish shade beyond an allowable color difference of the black color. In particular, when electrical characteristics attributed to carbon black are improved only with the blue coloring agent and the violet coloring agent in developer B, a larger amount of the blue coloring agent and the violet coloring agent should be added. Consequently, the hue has a bluish shade beyond an appropriate hue range. Alternatively, when electrical characteristics are improved with a coloring agent other than the blue coloring agent and the violet coloring agent, such improvement does not bring about an appropriate hue because of difference from a direction of desired color toning of the original carbon black hue (a hue having a reddish shade).

In contrast, the toner particles contained in the developer according to the present embodiment contain carbon black (the first coloring agent), a violet pigment (the second coloring agent) composed of one or more of C. I. Pigment Violet 19 and C. I. Pigment Violet 23, and a brown pigment (the third coloring agent) composed of one or more of C. I. Pigment Brown 23 and C. I. Pigment Brown 25. A content of the violet pigment is not lower than 8 mass % and not higher than 25 mass % with respect to the total amount of the coloring agents.

Unlike the blue pigment, the violet pigment and the brown pigment do not have metal atoms in a chemical structure thereof. Namely, conductivity of the second coloring agent composed of the violet pigment and the third coloring agent composed of the brown pigment is low. Therefore, since the developer according to the present embodiment can keep conductivity sufficiently lower than the toner particles contained in the conventional developer (developer A and developer B), dissatisfactory transfer can be prevented.

The violet pigment and the brown pigment have features of high color strength among various coloring agents. Therefore, with the toner particles contained in the developer according to the present embodiment, an amount of addition of a coloring agent other than carbon black can be smaller than in conventional developer B, and hence a ratio of a resin can be maintained at a sufficient amount. Therefore, the developer according to the present embodiment can be excellent in fixability.

The violet pigment has a hue having a more bluish shade than carbon black, and the brown pigment has a hue having a more reddish shade than carbon black. Therefore, by using both of them, a hue can be prevented from having a bluish shade as in the case of developer B and the hue can be close to neutral.

Therefore, according to the developer in the present embodiment, the hue can be satisfied, dissatisfactory transfer can also be prevented, and fixability can be excellent.

In particular, since the brown pigment has a high electrical resistance, conductivity of carbon black can be relaxed and lowered by using the brown pigment together. Namely, according to the developer in the present embodiment, sufficient chargeability can be exhibited without excessive lowering in content of carbon black. The violet pigment can improve dispersibility of carbon black by being used together with carbon black. Namely, according to the developer in the present embodiment, even though a content of carbon black is increased to a content which has conventionally been considered as inappropriate, dispersibility of carbon black can be maintained and hence lowering in fixability and lowering in color reproducibility attributed to a content of carbon black can be suppressed.

Therefore, according to the developer in the present embodiment, even though a content of carbon black is increased, the effect above can be exhibited. In addition, by increasing a content of carbon black, a high image density can be realized and excellent color reproducibility can be maintained.

For example, when only carbon black and a violet pigment are used together, it is naturally difficult to achieve a condition of $\Delta E<6$ in connection with a color difference from an ideal value for a black color and conductivity cannot sufficiently be lowered nor can the problem of transferability be prevented. Alternatively, when only carbon black and a brown pigment are used together, it is naturally difficult to achieve a condition of $\Delta E<6$ in connection with a color difference from an ideal value for a black color and dispersibility of carbon black cannot be improved nor can fixability be improved.

[Method of Manufacturing Developer for Electrostatic Latent Image]

The developer according to the present embodiment can be manufactured with toner particles manufactured with a conventional method of manufacturing toner particles. The conventional method of manufacturing toner particles can be exemplified, for example, by a granulation method or a crushing method. The granulation method is one of most suitable manufacturing methods since it is higher in energy efficiency and smaller in number of steps than the crushing method. Such a granulation method is a suitable manufacturing method also from a point of view of ease in obtaining toner particles having a small diameter and having uniform particle size distribution.

Among others, the granulation method allows formation of desired toner particles while a shape or a size of particles is controlled during a manufacturing process, and it is optimal for fabrication of toner particles small in diameter, which allow reproduction of a small dot image with high fidelity. With the granulation method, toner particles having the core/shell structure can readily be manufactured with high accuracy. The granulation method includes a suspension polymerization method, an emulsion polymerization method, a fine particle aggregation method, a droplet method of forming a droplet by adding a poor solvent to a resin solution, and a spray drying method.

A method of manufacturing a dry developer containing toner particles having the core/shell structure and a resin-coated carrier with the emulsion polymerization method will be described below by way of example of a method of manufacturing a dry developer, and a method of manufacturing a liquid developer containing toner particles having the core/shell structure and an insulating liquid serving as a carrier with the droplet method will be described by way of example of a method of manufacturing a liquid developer.

(Method of Manufacturing Dry Developer)

With the method of manufacturing a dry developer with the emulsion polymerization method, toner particles having the core/shell structure are manufactured mainly through each of a step of fabrication of a core resin dispersion liquid, a step of fabrication of a coloring agent dispersion liquid, a step of aggregation and fusion of a core resin (a step of fabrication of core particles), a first aging step, a step of forming a shell, a second aging step, a cooling step, a cleaning step, a drying step, and a step of treatment with an external additive. The dry developer is manufactured through a mixing step of mixing the manufactured toner particles and the resin-coated carrier. Each step will sequentially be described below.

(1) Step of Fabrication of a Core Resin Dispersion Liquid

In the present step, a core resin dispersion liquid composed of a styrene acrylic copolymer is fabricated. In the core resin dispersion liquid, a resin forming a core of toner particles is dispersed in a form of particles.

Specifically, a styrene monomer and an acrylic acid ester monomer are introduced and dispersed in a water based medium together with a surfactant, and a polymerization initiator is added for polymerization of monomers. Thus, a core resin dispersion liquid in which particles formed of the core resin composed of the styrene acrylic copolymer (hereinafter also referred to as the "core resin particles") are dispersed in the water based medium is fabricated. The core resin particles have a median diameter preferably not smaller than 50 nm and not greater than 300 nm.

A suitable styrene monomer is exemplified by styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, and p-n-dodecylstyrene.

A suitable acrylic acid ester monomer is exemplified by an acrylic acid ester monomer such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, and phenyl acrylate, and a methacrylic acid ester monomer such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, and dimethylaminoethyl methacrylate.

One of these acrylic acid ester monomers can be used alone, and in addition, two or more types thereof as combined can also be used. Namely, any of formation of a copolymer by using a styrene monomer and two or more types of acrylic acid ester monomers, formation of a copolymer by using a styrene monomer and two or more types of methacrylic acid ester monomers, and formation of a copolymer by using a styrene monomer as well as an acrylic acid ester monomer and a methacrylic acid ester monomer together is possible.

A known oil-soluble or water-soluble polymerization initiator can be used as the polymerization initiator. An oil-soluble polymerization initiator includes an azo based or diazo based polymerization initiator or a peroxide based polymerization initiator. Specifically, an azo based or diazo based polymerization initiator such as 2,2'-azobis-(2,4-dimethyl valeronitrile), 2,2'-azobisisobutyronitrile, 1,1'-azobis (cyclohexane-1-carbonitrile), 2,2'-azobis-4-methoxy-2,4-dimethyl valeronitrile, and azobisisobutyronitrile; and a peroxide based polymerization initiator such as benzoyl peroxide, methyl ethyl ketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis-(4,4-t-butylperoxycyclohexyl) propane, and tris-(t-butylperoxy) triazine can be given as examples. A water-soluble polymerization initiator includes persulfate such as potassium persulfate and ammonium persulfate, azobisaminodipropanacetate, azobis cyanovaleric acid and salt thereof, and hydrogen peroxide.

A known chain transfer agent can also be used for adjustment of a molecular weight of core resin particles. Specifically, octyl mercaptan, dodecyl mercaptan, tert-dodecyl mercaptan, n-octyl-3-mercaptopropionic acid ester, carbon tetrabromide, and α-methylstyrene dimer are given as examples.

In the present step, a surfactant is preferably used for uniformly dispersing an oil drop of a polymeric monomer in a water based medium. Though a surfactant used here is not particularly limited, for example, an ionic surfactant such as sulfonate, sulfuric acid ester salt, and fatty acid salt can be used as a preferred surfactant.

For example, sodium dodecylbenzenesulfonate, aryl alkyl polyether sodium sulfonate, 3,3-disulfone diphenylurea-4,4-diazo-bis-amino-8-naphthol-6-sodium sulfonate, o-carboxybenzene-azo-dimethylaniline, and 2,2,5,5-tetramethyl-triphenylmethane-4,4-diazo-bis-β-naphthol-6-sodium sulfonate are exemplified as suitable sulfonate.

For example, sodium lauryl sulfate, sodium dodecyl sulfate, sodium tetradecyl sulfate, sodium pentadecyl sulfate, and sodium octyl sulfate are available as suitable sulfuric acid ester salt, and sodium oleate, sodium laurate, sodium caprate, sodium caprylate, sodium caproate, potassium stearate, and calcium oleate are exemplified as fatty acid salt.

A nonionic surfactant can also be used as the surfactant, and specifically, polyethylene oxide, polypropylene oxide, combination of polypropylene oxide and polyethylene oxide, ester of polyethylene glycol and higher fatty acid, alkylphenol polyethylene oxide, ester of higher fatty acid and polyethylene glycol, ester of higher fatty acid and polypropylene oxide, and sorbitan ester are given as examples.

(2) Step of Fabrication of a Coloring Agent Dispersion Liquid

In the present step, a coloring agent is introduced and dispersed in a water based medium together with a surfactant to thereby fabricate a dispersion liquid in which particles of a coloring agent (hereinafter also referred to as the "coloring agent particles") are dispersed. The coloring agent particles have a median diameter D50 preferably not smaller than 50 nm and not greater than 200 nm.

(3) Step of Aggregation and Fusion of a Core Resin (Step of Fabricating Core Particles)

In the present step, the core resin particles and the coloring agent particles are aggregated in a water based medium and these particles are fused simultaneously with aggregation, to thereby fabricate the core particles. The core particles here are such core particles that coloring agent particles are dispersed in a resin forming the core.

Specifically, a flocculating agent is added to the water based medium in which the fabricated core resin particles and the coloring agent particles have been mixed. Thus, the core resin particles and the coloring agent particles are aggregated and simultaneously the particles are fused with one another. Then, when the core particles have grown to a desired size, aggregation is stopped by adding salt such as saline. The core particles having a desired size, which are composed of the core resin and the coloring agent, are fabricated. The core particles have a median diameter D50 preferably not smaller than 3.0 μm and not greater than 7.0 μm.

Alkali metal salt or alkaline earth metal salt such as salt of a monovalent metal such as salt of an alkali metal including sodium, potassium, and lithium, salt of a divalent metal such as calcium, magnesium, manganese, and copper, salt of a trivalent metal such as iron and aluminum can be employed as the flocculating agent. Specifically, sodium chloride, potassium chloride, lithium chloride, calcium chloride, magnesium chloride, zinc chloride, copper sulfate, magnesium sulfate, and manganese sulfate are given as examples. Salt of a divalent metal is preferred among these because aggregation can proceed with a smaller amount. One type or two or more types of these as combined may be used.

In the present step, a temperature of the water based medium which is a reaction system is preferably raised to a temperature not lower than a glass transition point of the core resin. Thus, aggregation can proceed and fusion can be promoted. An amount of addition of the coloring agent particles is preferably not lower than 1 mass % and not higher than 40 mass % with respect to the total amount of toner particles (including also another material added in a subsequent stage) in solid content equivalent.

In the present step, a dispersion stabilizer is preferably added to the reaction system. Since the core resin particles and the coloring agent particles can thus uniformly be dispersed in a reaction solution, subsequent aggregation and fusion can uniformly take place.

For example, tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica, and alumina are given as examples of a dispersion stabilizer. In addition, a substance generally used as a surfactant such as polyvinyl alcohol, gelatin, methyl cellulose, sodium dodecylbenzenesulfonate, an ethylene oxide adduct, and higher alcohol sodium sulfate can also be used.

In the present step, when a temperature of the water based medium is set to be slightly high and a time period for fusion is set to be slightly long, the core particles have a rounded shape and simultaneously a surface is smoothened. Therefore, the core particles having a smooth surface can be fabricated.

(4) First Aging Step

In the present step, aging is carried out until the core particles achieve a desired shape, by subjecting the reaction system to heating treatment subsequent to the step of aggregation and fusion described above. In this step as well, by setting a heating temperature to be slightly high and setting a time period for treatment to be slightly long, the core particles having a smooth surface can be fabricated.

(5) Step of Forming a Shell

In the present step, a shell layer is formed on surfaces of the core particles by adding particles composed of a shell resin (hereinafter referred to as the "shell resin particles") to the dispersion liquid of the core particles formed in the first aging step, to thereby cover the surfaces of the core particles with the shell resin particles.

For example, a modified polyester resin having such a structure that a styrene acrylic copolymer molecular chain (also referred to as a styrene acrylic copolymer segment) is molecularly bonded to a polyester molecular chain (also referred to as a polyester segment) can be employed as the shell resin. Among these, a polyester resin of which content of a styrene acrylic copolymer segment is not lower than 5 mass % and not higher than 30 mass % is preferred.

Here, a content of a styrene acrylic copolymer segment occupied in the modified polyester resin (styrene acrylic modified polyester molecule) is also referred to as a "styrene acrylic modified amount," and it represents a ratio (a mass ratio) of the styrene acrylic copolymer segment occupied in the modified polyester resin. Specifically, it refers to a ratio of a mass of a polymeric monomer used for forming a styrene acrylic copolymer to a total mass of a polymeric monomer used in synthesizing a modified polyester resin. By setting the "styrene acrylic modified amount" to the range above, the shell layer can more reliably be formed, probably for the following reason.

By using the modified polyester resin as the shell resin, moderate affinity to the surfaces of the core particles can be expressed and firm bond between the core particles and the shell layer can be formed. In addition, since moderate dispersibility acts between shell resin particles, aggregation among the shell resin particles is less likely and a thin shell layer is uniformly formed on the surfaces of the core particles.

An amount of addition of the modified polyester resin in the present step is preferably set such that the shell layer has a thickness approximately not smaller than 20 nm and not greater than 500 nm. Specifically, an amount of addition of the shell resin particles is preferably not lower than 1 mass % and not higher than 40 mass % and preferably not lower than 5 mass % and not higher than 30 mass % in the total amount of toner particles, in solid content equivalent.

(6) Second Aging Step

In the present step, covering of the surfaces of the core particles with the shell layer is strengthened by subjecting the reaction system to heating treatment subsequent to the step of forming a shell and aging is carried out until the toner particles achieve a desired shape. By setting a heating temperature to be slightly high and setting a time period for treatment to be slightly long in this step, toner particles having high circularity and a smooth surface can be fabricated.

(7) Cooling Step

In the present step, the dispersion liquid subjected to the second aging step, that is, the dispersion liquid in which the toner particles having the core/shell structure have been dispersed (hereinafter referred to as the "toner particle dispersion liquid") is cooled. Specifically, the dispersion liquid is cooled at a cooling rate preferably from 1 to 20° C./min. A cooling method is not particularly limited, and for example, a method of cooling by introducing a coolant from the outside of a vessel accommodating a dispersion liquid and a method of cooling by introducing cold water directly into a dispersion liquid can be given as examples.

(8) Cleaning Step

In the present step, the toner particles are subjected to solid-liquid separation from the dispersion liquid of the toner particles subjected to the cooling step, and such deposits as a surfactant and a flocculating agent are removed from the surfaces of the toner particles. Specifically, initially, the toner particles are separated from the dispersion liquid of the toner particles through solid-liquid separation. The separated toner particles are formed into a lump like a wet cake. Then, the lump like a cake is subjected to cleaning treatment with the use of water until electrical conductivity of a filtrate is not higher than a desired value, for example, to a level of 10 μS/cm. Thus, wet toner particles from which unnecessary deposits have been removed are obtained. Known treatment methods such as a centrifugation method, a reduced-pressure filtering method performed with the use of a Nutsche or the like, and a filtering method with the use of a filter press can be employed for solid-liquid separation and cleaning treatment.

(9) Drying Step

In the present step, the toner particles subjected to the cleaning step are subjected to drying treatment to thereby obtain dry toner particles. Known dryers such as a spray dryer, a vacuum freeze dryer, and a reduced-pressure dryer are exemplified as a dryer used in this step, and a stationary shelf dryer, a moving shelf dryer, a fluidized bed dryer, a rotary dryer, an agitation dryer, and the like can also be used. An amount of moisture contained in the toner particles subjected to drying treatment is preferably not higher than 5 mass % and more preferably not higher than 2 mass %. In a case where the toner particles subjected to drying treatment aggregate owing to weak interparticle attraction, the aggregate may be subjected to cracking treatment. Here, a mechanical cracking apparatus such as a jet mill, a Henschel mixer, a coffee mill, and a food processor can be used as a cracking treatment apparatus.

(10) Step of Treatment with an External Additive

In the present step, after the toner particles are subjected to drying treatment, an external additive is added and mixed as necessary to thereby add the external additive to the surfaces of the toner particles. An external additive is formed from monodisperse spherical particles preferably having a number average primary particle size not smaller than 5 nm and not greater than 150 nm.

(11) Mixing Step

In the present step, a dry developer containing toner particles is manufactured by mixing the toner particles having the core-shell structure manufactured by performing the steps in (1) to (10) above and a resin-coated carrier. When the core particles not subjected to the step of forming a shell are employed as toner particles, toner particles do not have the core/shell structure. A method of mixing the toner particles and the resin-coated carrier is not particularly restricted, and a known mixing method can be employed.

The resin-coated carrier can be fabricated by using a known carrier manufacturing apparatus. The carrier manufacturing apparatus is an apparatus for fabricating a resin-coated carrier in which a resin layer is formed on a surface of a core material by mixing and stirring particles for a core material (hereinafter also referred to as the "core material particles") and particles for a resin layer (hereinafter also referred to as the "resin particles") to thereby electrostatically adhere the resin particles onto surfaces of the core material particles, then applying stress to the core material particles to which the resin particles have adhered while they are heated, and spreading the resin particles over the surfaces of the core material particles.

In fabricating the resin-coated carrier, the core material particles and the resin particles which are source materials are supplied to the inside of a container main body through a source material inlet port. A rotary vane stirs the core material particles and the resin particles as it is rotated by a motor representing drive means. By controlling actuation of the rotary vane, an operation for electrostatically adhere the resin particles to the surfaces of the core material particles and an operation for strongly securing the electrostatically adhering resin particles to the surfaces of the core material particles can be performed in a stepwise fashion.

Namely, the resin-coated carrier having such a structure that the surfaces of the core material particles are coated with the resin layer can be fabricated at least through (A) the step of stirring and mixing the core material particles and the resin particles at room temperature to thereby adhere the resin particles to the surfaces of the core material particles owing to an action of static electricity, (B) the step of forming a resin-coated layer by spreading the resin particles over the surfaces of the core material particles and covering the same by applying mechanical impact while a chamber is heated to a temperature not lower than a glass transition point of the resin particles, to thereby form resin coating layers, and (C) the step of cooling the chamber to a room temperature. The steps of (A) to (C) above can also be repeated a plurality of times as necessary.

(Method of Manufacturing Liquid Developer)

With the method of manufacturing a liquid developer with the droplet method, toner particles having the core/shell structure are manufactured as below and a liquid developer in which these toner particles are dispersed in an insulating liquid is manufactured.

Initially, by dissolving a resin in a good solvent, a solution for forming a core resin, which contains a core resin, is obtained. Then, the solution for forming a core resin above is mixed, together with an interfacial tension adjuster (the shell resin), in a poor solvent different in SP value from the good solvent, shear is provided, and thus a droplet is formed. Thereafter, the good solvent is volatilized. Toner particles having the core/shell structure are thus obtained. By employing the insulating liquid as the poor solvent, a solution obtained as a result of volatilization of the good solvent can serve as the liquid developer in which the toner particles having the core/shell structure have been dispersed in the insulating liquid. With this method, a particle size or a shape of toner particles can readily be controlled by varying how to provide shear, difference in interfacial tension, or an interfacial tension adjuster.

[Image Formation Apparatus]

The developer according to the present embodiment can form an image with the use of an image formation apparatus. A construction of the image formation apparatus is not particularly limited, and for example, an image formation apparatus suitably used with a two-component dry developer as shown in FIG. 1 or an image formation apparatus suitably used with a liquid developer as shown in FIG. 2 is exemplified.

<Image Formation Apparatus Used with Dry Developer>

Figure 2:
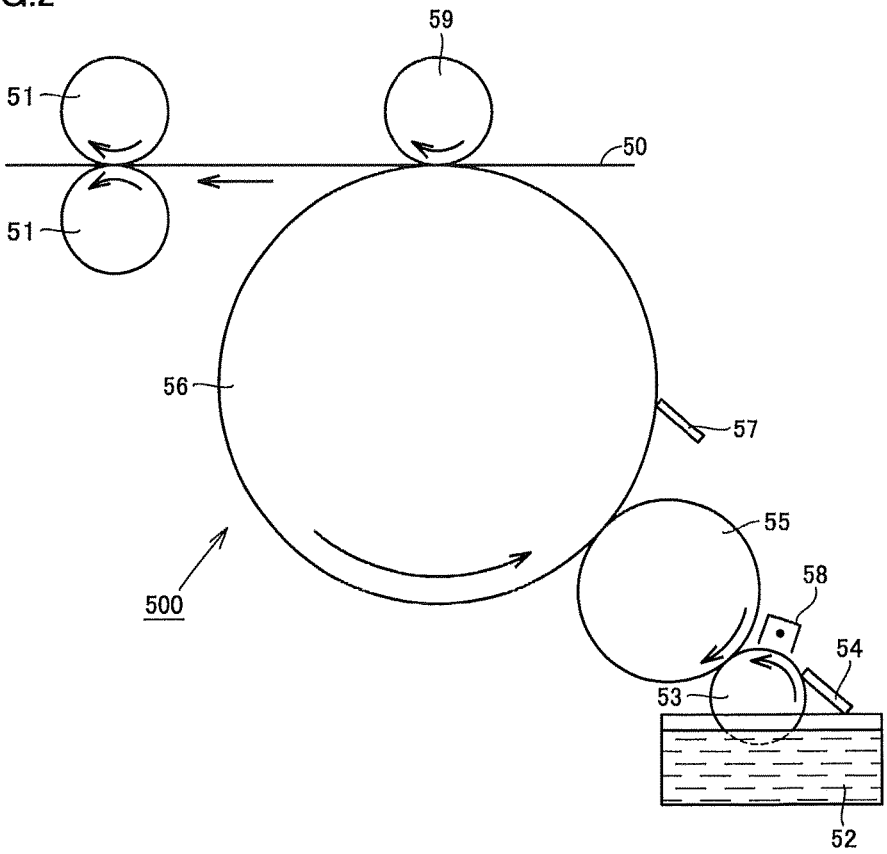
FIG. 2 is a schematic conceptual diagram of an image formation apparatus employed in Examples.

An image formation apparatus 100 in FIG. 1 is called a tandem type color image formation apparatus, and it has a plurality of sets of image formation portions 10Y, 10M, 10C, 10K, an endless belt type intermediate transfer element unit 7 serving as a transfer portion, and endless belt type paper feed transportation means 21 for transporting a recording medium P and a heat roll fixation apparatus 24 as fixation means. A document image scanner SC is arranged in an upper portion of a main body A of the image formation apparatus. Photoconductors 11Y, 11M, 11C, 11K, development apparatuses 14Y, 14M, 14C, 14K, primary transfer rolls 15Y, 15M, 15C, 15K serving as primary transfer means, a secondary transfer roll 15A serving as secondary transfer means, cleaning apparatuses 16Y, 16M, 16C, 16K, and an intermediate transfer element 70 are provided.

Image formation portion 10Y forming a yellow image as one of toner images in a different color formed in each photoconductor has drum-shaped photoconductor 11Y serving as a first photoconductor, charging means 12Y arranged around photoconductor 11Y, exposure means 13Y, development means 14Y, primary transfer roll 15Y serving as the primary transfer means, and cleaning apparatus 16Y.

Preferably, cleaning apparatus 16Y is provided with a cleaning blade which is a main cleaning member and equipped with a cleaning roller brought in contact with transfer residue toner before removal of transfer residue toner by the cleaning blade. The cleaning roller is preferably a roller in which a surface of a cored bar is covered with such an elastic body as silicone rubber or urethane foam. A cleaning roller which follows the photoconductor in a manner in contact therewith suffices, however, a cleaning roller driven at a speed 1.1 to 2.0 times as high as a peripheral speed of the photoconductor is preferred, because occurrence of filming can be prevented without causing abrasion of a surface of the photoconductor.

In addition, image formation portion 10M forming a magenta image as one of toner images in another different color has drum-shaped photoconductor 11M serving as the first photoconductor, charging means 12M arranged around photoconductor 11M, exposure means 13M, development means 14M, primary transfer roll 15M serving as the primary transfer means, and cleaning apparatus 16M. It is noted that cleaning apparatus 16M is desirably the same in construction as cleaning apparatus 16Y described previously.

Moreover, image formation portion 10C forming a cyan image as one of toner images in another different color has drum-shaped photoconductor 11C serving as the first photoconductor, charging means 12C arranged around photoconductor 11C, exposure means 13C, development means 14C, primary transfer roll 15C serving as the primary transfer means, and cleaning apparatus 16C. It is noted that cleaning apparatus 16C is desirably the same in construction as cleaning apparatus 16Y described previously.

Furthermore, image formation portion 10K forming a black image as one of toner images in another different color has drum-shaped photoconductor 11K serving as the first photoconductor, charging means 12K arranged around photoconductor 11K, exposure means 13K, development means 14K, primary transfer roll 15K serving as the primary transfer means, and cleaning apparatus 16K. It is noted that cleaning apparatus 16K is desirably the same in construction as cleaning apparatus 16Y described previously.

Endless belt type intermediate transfer element unit 7 has endless belt type intermediate transfer element 70 serving as a second image carrier of an intermediate transfer endless belt type wound around and circulatably supported by a plurality of rolls 71, 72, 73, 74, 76, and 77.

Images of respective colors formed by image formation portions 10Y, 10M, 10C, 10K are successively transferred onto circulating endless belt type intermediate transfer element 70 by primary transfer rolls 15Y, 15M, 15C, 15K, so that a combined color image is formed. Recording medium P such as paper serving as a transfer material accommodated in a paper feed cassette 20 is fed by paper feed transportation means 21, passes by a plurality of intermediate rolls 22A, 22B, 22C, 22D and a registration roll 23, and is transported to secondary transfer roll 15A serving as the secondary transfer means, so that the color image is collectively transferred onto recording medium P. Recording medium P on which the color image has been transferred is subjected to fixation treatment by heat roll fixation apparatus 24, sandwiched between paper ejection rolls 25, and placed on a paper ejection tray 26 outside.

On the other hand, after the color image is transferred to recording medium P by means of secondary transfer roll 15A, remaining toner is removed by a cleaning apparatus 16A from endless belt type intermediate transfer element 70 which has self-stripped recording medium P. Preferably, cleaning apparatus 16A is provided with a cleaning blade which is a main cleaning member and equipped with a cleaning roller brought in contact with remaining toner before removal of remaining toner by the cleaning blade. The cleaning roller is preferably a roller in which a surface of a cored bar is covered with such an elastic body as silicone rubber or urethane foam. A cleaning roller which follows endless belt type intermediate transfer element 70 in a manner in contact therewith suffices, however, a cleaning roller driven at a speed 1.1 to 2.0 times as high as a peripheral speed of endless belt type intermediate transfer element 70 is preferred, because occurrence of filming can be prevented without causing abrasion of a surface of endless belt type intermediate transfer element 70.

During a process for image formation, primary transfer roll 15K is always pressure-contacted with photoconductor 11K. Other primary transfer rolls 15Y, 15M, 15C are pressure-contacted with respective corresponding photoconductors 11Y, 11M, 11C only during color image formation. In contrast, secondary transfer roll 15A pressure-contacts with endless belt type intermediate transfer element 70 only when recording medium P passes thereby and secondary transfer is carried out.

Thus, toner images are formed on photoconductors 11Y, 11M, 11C, 11K through charging, exposure, and development, and toner images of respective colors are layered on endless belt type intermediate transfer element 70, collectively transferred onto recording medium P, and securely fixed through pressurization and heating in heat roll fixation apparatus 24. After toner which was left on the photoconductors at the time of transfer is cleaned in cleaning apparatuses 16Y, 16M, 16C, 16K, photoconductors 11Y, 11M, 11C, 11K after the toner images have moved onto recording medium P enter a cycle of charging, exposure, and development above, where next image formation is carried out.

A full-color image formation method with the use of a non-magnetic one-component developer can be realized, for example, by using an image formation apparatus in which development means 14Y, 14M, 14C, 14K for two-component developer described previously are replaced with known development means for a non-magnetic one-component developer.

<Image Formation Apparatus Used with Liquid Developer>

In FIG. 2, an image formation apparatus 500 mainly includes a heat roller 51, a development roller 53, a restriction blade 54, a photoconductor 55, an intermediate transfer element 56, a cleaning blade 57, a charging apparatus 58, and a back-up roller 59. In image formation apparatus 500, initially, a liquid developer 52 is leveled off by restriction blade 54 and a thin layer of liquid developer 52 is formed on development roller 53. Thereafter, toner particles move at a nip between development roller 53 and photoconductor 55 and a toner image is formed on photoconductor 55.

Then, the toner particles move at a nip between photoconductor 55 and intermediate transfer element 56 and a toner image is formed on intermediate transfer element 56. In succession, toner is superimposed on intermediate transfer element 56, and an image is formed on a recording medium 50. The image on recording medium 50 is fixed by heat roller 51.

Recording medium P and recording medium 50 used during image formation in image formation apparatus 100 and image formation apparatus 500 are not particularly limited, so long as a toner image can be formed thereon with an image formation method of an electrophotography type. Known recording media are exemplified as specific recording media P, and for example, plain paper from thin paper to cardboard, bond paper, art paper, or coated printing paper such as coated paper, commercially available Japan paper or postcard paper, a plastic film for OHP, fabric, and the like are exemplified.

In addition, a fixation method which can be performed in the image formation method with the use of the developer according to the present embodiment is not particularly limited, and a known fixation technique is available. A roller fixation technique using a heating roller and a pressurization roller, a fixation technique using a heating roller and a pressurization belt, a fixation technique using a heating belt and a pressurization roller, a belt fixation technique using a heating belt and a pressurization belt, and the like are available as known fixation techniques, and any technique may be adopted. Moreover, any known heating technique such as a technique with the use of a halogen lamp and an IH fixation technique can be adopted as the heating technique.

EXAMPLES

Though the present invention will be described below in further detail with reference to Examples, the present invention is not limited thereto. It is noted that "part(s)" in Examples refer(s) to "part(s) by mass" unless otherwise specified.

[Manufacturing of Liquid Developer]

The liquid developers according to the present invention were manufactured in Examples 1 to 13 and the liquid developers for comparison were manufactured in Comparative Examples 1 to 9. In Examples 1 to 13 and Comparative Examples 1 to 9, the liquid developers containing toner particles having the core/shell structure were manufactured.

<Manufacturing of Polyester Resin 1>

In a four-neck flask provided with a stirring rod, a partial condenser, a nitrogen gas introduction pipe, and a thermometer, 750 parts of an adduct of propylene oxide to bisphenol A (the general formula (I) below) (polyalcohol), 300 parts of terephthalic acid (polybasic acid), and 18 parts of trimellitic acid (polybasic acid) which were source material monomers were introduced, a nitrogen gas was introduced while they were stirred, and they were subjected to polycondensation at a temperature around 170° C. The temperature was lowered to approximately 100° C. at the time when Mn attained to approximately 3000, and polycondensation was stopped by adding 0.012 part of hydroquinone as a polymerization inhibitor.

(I)

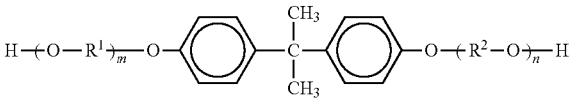

In the formula (I) expressing an adduct of propylene oxide to bisphenol A, $R^1$ and $R^2$ represent a propylene group, and m and n each independently represent 0 or a positive integer, the sum of which is from 1 to 16. The adduct of propylene oxide to bisphenol A is a mixture of several compounds.

A polyester resin 1 was thus obtained. Polyester resin 1 had measured Mn of 3500, an acid value of 18 mg KOH/g, and a glass transition point (Tg) of 64° C. A method of measuring Mn, an acid value, and a glass transition point of a resin is as follows, which is similarly applicable to other resins.

(Method of Measuring Molecular Weight)

Mn of a polyester resin was measured with GPC. A measurement conditions are as follows.

DETECTOR: RI (refraction index) detector

COLUMN: Shodex KF-404HQ (a trade name, manufactured by Showa Denko K.K.)+Shodex KF-402HQ (a trade name, manufactured by Showa Denko K.K.)

Solvent: tetrahydrofuran

Flow rate: 0.4 ml/min.

Calibration curve: standard polystyrene (Measurement of Acid Value)

An acid value (mg KOH/g) of a polyester resin was measured under conditions defined under JIS K5400.

(Measurement of Glass Transition Point)

A glass transition point (Tg) of a polyester resin was measured with a differential scanning calorimeter "DSC-6200" (manufactured by Seiko Instruments, Inc.) under conditions of a sample amount of 20 mg and a temperature increase rate of 10° C./min.

<Manufacturing of Polyester Resin 2>

A polyester resin 2 was manufactured with a method the same as that for polyester resin 1 except that 320 parts of terephthalic acid were used, 17 parts of trimellitic acid were used, and polycondensation was stopped by lowering a temperature at the time point when Mn attained to approximately 2800. Polyester resin 2 had measured Mn of 2850, an acid value of 12 mg KOH/g, and Tg of 66° C.

<Manufacturing of Polyester Resin 3>

A polyester resin 3 was manufactured with a method the same as that for polyester resin 1 except that 800 parts of an adduct of propylene oxide to bisphenol A (the general formula (I)) were used, 350 parts of terephthalic acid were used, and 12 parts of trimellitic acid were used. Polyester resin 3 had measured Mn of 3100, an acid value of 8 mg KOH/g, and Tg of 62° C.

<Manufacturing of Polyester Resin 4>

A polyester resin 4 was manufactured with a method the same as that for polyester resin 1 except that 820 parts of an adduct of propylene oxide to bisphenol A (the general formula (I)) were used, 350 parts of terephthalic acid were used, and 12 parts of trimellitic acid were used. Polyester resin 4 had measured Mn of 3050, an acid value of 5 mg KOH/g, and Tg of 62° C.

<Manufacturing of Polyester Resin 5>

A polyester resin 5 was manufactured with a method the same as that for polyester resin 1 except that 60 parts of trimellitic acid were used and polycondensation was stopped by lowering a temperature at the time point when Mn attained to approximately 2800. Polyester resin 5 had measured Mn of 2900, an acid value of 40 mg KOH/g, and Tg of 67° C.

<Manufacturing of Polyester Resin 6>

A polyester resin 6 was manufactured with a method the same as that for polyester resin 1 except that 820 parts of an adduct of propylene oxide to bisphenol A (the general formula (I)) were used, 360 parts of terephthalic acid were used, and 10 parts of trimellitic acid were used. Polyester resin 6 had measured Mn of 3050, an acid value of 4 mg KOH/g, and Tg of 61° C.

<Manufacturing of Polyester Resin 7>

A polyester resin 7 was manufactured with a method the same as that for polyester resin 1 except that 63 parts of trimellitic acid were used and polycondensation was stopped by lowering a temperature at the time point when Mn attained to approximately 2800. Polyester resin 7 had measured Mn of 3000, an acid value of 42 mg KOH/g, and Tg of 69° C.

Example 1

To 51 parts of polyester resin 1, 18.0 parts of carbon black (a trade name: "Mogul L" manufactured by Cabot Corporation) as the first coloring agent, 6 parts of C. I. Pigment Violet 23 (a trade name: "Cromophtal® Violet D 5800" manufactured by Clariant Japan K. K.) as the second coloring agent, 11 parts of C. I. Pigment Brown 25 (a trade name: "PV Fast Brown HFR" manufactured by Clariant Japan K. K.) as the third coloring agent, 480 parts of acetone, and 10 parts of a dispersant for coloring agent (a trade name: "Ajisper PB-822" manufactured by Ajinomoto Fine-Techno Co., Inc.), 500 parts of glass beads were added and dispersed for 3 hours with the use of a paint conditioner. A resin solution X in which the coloring agents (the first coloring agent, the second coloring agent, and the third coloring agent) had been dispersed in polyester resin 1 was fabricated by thereafter removing the glass beads.

Then, 4 parts of an N-vinylpyrrolidone/alkylene copolymer (a trade name: "Antaron V-216" manufactured by GAF/ISP Chemicals) as an interfacial tension adjuster (the shell resin) were dissolved in 400 parts of an insulating liquid (a trade name: "IP Solvent 2028" manufactured by Idemitsu Petrochemical Co., Ltd.) and a homogenizer was activated. A precursor of the liquid developer was fabricated by introducing 576 parts of resin solution X in the activated homogenizer and carrying out dispersion for 5 minutes.

Then, after acetone was removed from the precursor of the liquid developer with an evaporator, the precursor was stored for 4 hours in a thermostatic bath set to 50° C. Thus, the liquid developer containing the toner particles and the insulating liquid was fabricated. The toner particles contained the resin (polyester resin 1) and the coloring agents composed of carbon black, C. I. Pigment Violet 23 (17.1 mass % with respect to the total amount of the coloring agents), and C. I. Pigment Brown 25 (the total content of the coloring agents in the toner particles being 35 mass %) and had a volume average particle size (median diameter D50) of 1.3 μm.

An average particle size of toner particles represents a volume average particle size measured with a particle size distribution measurement apparatus (a trade name: "FPIA-3000S" manufactured by Sysmex Corporation) (similarly hereinafter).

Examples 2 to 13 and Comparative Examples 1 to 9

The liquid developers were fabricated as in Example 1 except that a type of a resin, an amount of addition (a content) of the resin, a type of carbon black (the first coloring agent), an amount of addition of carbon black, a type of a coloring agent (the second coloring agent, the third coloring agent, and other coloring agents), and an amount of addition of each coloring agent were set as shown in Table 1. Each toner particle contained in each liquid developer also had an average particle size around 1.3 μm.

TABLE 1

| | Resin | | First Coloring Agent | | | Second Coloring Agent | | Third Coloring Agent | | Other Coloring Agents | | Ratio of Second | Total Amount of |
|---|---|---|---|---|---|---|---|---|---|---|---|---|---|
| | Type | Acid Value | Type | pH | Amount (wt %) | Type | Amount (wt %) | Type | Amount (wt %) | Type | Amount (wt %) | Coloring Agent | Coloring Agents (wt %) |
| Example 1 | PES1 | 18 | CB1 | 5.8 | 18.0 | V1 | 6.0 | BR1 | 11.0 | — | — | 17.1 | 35 |
| Example 2 | PES1 | 18 | CB1 | 5.8 | 18.0 | V2 | 8.5 | BR2 | 8.5 | — | — | 24.3 | 35 |
| Example 3 | PES1 | 18 | CB1 | 5.8 | 20.0 | V1 | 3.0 | BR1 | 12.0 | — | — | 8.6 | 35 |
| Example 4 | PES2 | 12 | CB1 | 5.8 | 16.0 | V2 | 6.0 | BR1 | 13.0 | — | — | 17.1 | 35 |
| Example 5 | PES3 | 8 | CB1 | 5.8 | 18.0 | V1 | 6.0 | BR2 | 9.0 | M1 | 2.0 | 17.1 | 35 |
| Example 6 | PES4 | 5 | CB1 | 5.8 | 19.0 | V1 | 6.0 | BR2 | 10.0 | — | — | 17.1 | 35 |
| Example 7 | PES5 | 40 | CB1 | 5.8 | 18.0 | V2 | 6.0 | BR2 | 11.0 | — | — | 17.1 | 35 |
| Example 8 | PES6 | 4 | CB1 | 5.8 | 18.0 | V1 | 6.0 | BR2 | 11.0 | — | — | 17.1 | 35 |
| Example 9 | PES7 | 42 | CB1 | 5.8 | 18.0 | V2 | 6.0 | BR1 | 11.0 | — | — | 17.1 | 35 |
| Example 10 | PES1 | 18 | CB2 | 7.6 | 18.0 | V1 | 6.0 | BR1 | 11.0 | — | — | 17.1 | 35 |
| Example 11 | PES6 | 4 | CB2 | 7.6 | 18.0 | V2 | 6.0 | BR1 | 11.0 | — | — | 17.1 | 35 |
| Example 12 | PES1 | 18 | CB1 | 5.8 | 13.0 | V1 | 3.0 | BR2 | 4.0 | — | — | 15.0 | 20 |
| Example 13 | PES1 | 18 | CB1 | 5.8 | 22.0 | V1 | 8.0 | BR2 | 10.0 | — | — | 20.0 | 40 |
| Comparative Example 1 | PES1 | 18 | CB1 | 5.8 | 18.0 | V1 | 7.0 | — | — | C1 | 10.0 | 20.0 | 35 |
| Comparative Example 2 | PES1 | 18 | CB1 | 5.8 | 18.0 | — | — | BR2 | 17.0 | — | — | — | 35 |
| Comparative Example 3 | PES1 | 18 | CB1 | 5.8 | 18.0 | V1 | 17 | — | — | — | — | 48.6 | 35 |
| Comparative Example 4 | PES1 | 18 | CB1 | 5.8 | 18.0 | V2 | 17 | — | — | — | — | 48.6 | 35 |
| Comparative Example 5 | PES1 | 18 | — | — | — | V1 | 17 | BR2 | 18.0 | — | — | 48.6 | 35 |
| Comparative Example 6 | PES1 | 18 | CB1 | 5.8 | 18.0 | — | — | BR2 | 9.0 | C1 | 8.0 | — | 35 |
| Comparative Example 7 | PES1 | 18 | CB1 | 5.8 | 18.0 | V3 | 7.0 | BR2 | 10.0 | — | — | 20.0 | 35 |
| Comparative Example 8 | PES1 | 18 | CB1 | 5.8 | 18.0 | V1 | 2.5 | BR2 | 14.5 | — | — | 7.1 | 35 |
| Comparative Example 9 | PES1 | 18 | CB1 | 5.8 | 18.0 | V1 | 9.0 | BR2 | 8.0 | — | — | 25.7 | 35 |

Various signs in Table 1 mean the following.
PES1: Polyester resin 1
PES2: Polyester resin 2
PES3: Polyester resin 3
PES4: Polyester resin 4
PES5: Polyester resin 5
PES6: Polyester resin 6
CB1: Carbon black ("Mogul L" manufactured by Cabot Corporation)
CB2: Carbon black ("MA 77" manufactured by Mitsubishi Chemical Corporation)
V1: C.I. Pigment Violet 23 ("Cromophtal ® Violet D 5800" manufactured by Clariant Japan K. K.)
V2: C.I. Pigment Violet 19 ("Cinquasia Violet K 5350FP" manufactured by Clariant Japan K. K.)
V3: C.I. Pigment Violet 27 ("Basoflex Violet 6140" manufactured by BASF)
BR1: C.I. Pigment Brown 25 ("PV Fast Brown HFR" manufactured by Clariant Japan K. K.)
BR2: C.I. Pigment Brown 23 ("Cromophtal ® Brown 5R" manufactured by BASF)
M1: C.I. Pigment Red 122 ("FASTOGEN Super Magenta RTS" manufactured by DIC Corporation)
C1: C.I. Pigment Blue 15:3 ("Fastogen Blue GNPT" manufactured by DIC Corporation)
It is noted that an empty field ("—") in Table 1 indicates that no corresponding substance is contained.
The "ratio of second coloring agent" in Table 1 represents a ratio (mass %) of the second coloring agent with respect to the total amount of the coloring agents contained in the toner particles, and the "total amount of coloring agents" represents a ratio (mass %) of the total amount of the coloring agents with respect to a mass of the toner particles.

[Evaluation of Characteristics of Liquid Developer]

An image was formed with the image formation apparatus shown in FIG. 2 in connection with each liquid developer in Examples 1 to 13 and Comparative Examples 1 to 9, and transferability, an image density, fixability, and color reproducibility were evaluated by using each image.

<Process and Process Condition of Image Formation Apparatus>

The image formation apparatus shown in FIG. 2 was used, each dry developer in Examples 14 to 24 and Comparative Examples 10 to 18 was used as black toner in an environment where a temperature was 35° C. and a relative humidity was 65% RH, and images were created by making 2000 continuous prints for each dry developer without using toner of other colors.

An image created in continuous prints was such that an image of a photography of a person's face, a halftone image having relative reflection density of 0.4, a white background image, and a solid image having relative reflection density of 1.3 were output in quarters on a recording medium (coated paper) of A4 size. It is noted that relative reflection density of the halftone image and the solid image was represented as a measurement value with the use of a Macbeth reflection density meter (a trade name: "RD918", manufactured by Sakata Inx Eng. Co., Ltd.).

Figure 3:
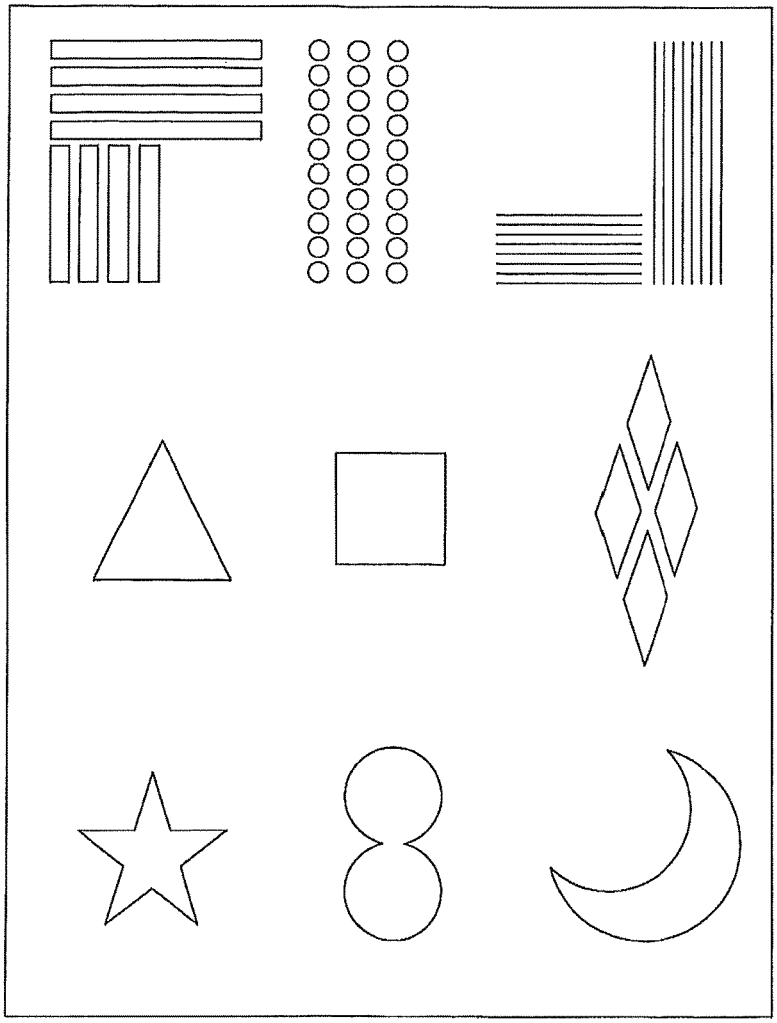
FIG. 3 is a diagram showing an image used in evaluation of Examples.

Then, at the end of making of 2000 continuous prints, an image shown in FIG. 3 was continuously printed on 10 sheets such that an amount of adhesion on the recording medium (coated paper) was 4.5 g/m$^2$, which were in turn used for evaluation. Details of the process are as described above and process conditions are as follows.

System Speed: 40 cm/s

Photoconductor: Negatively charged OPC

Charge Potential: −700 V

Development Voltage (Voltage Applied to Development Roller): −450 V

Primary Transfer Voltage (Voltage Applied to Transfer Roller): +600 V

Secondary Transfer Voltage: +1200 V

Pre-Development Corona CHG: Adjusted as appropriate between −3 and 5 kV of needle application voltage <Transferability>

The image formation apparatus shown in FIG. 2 was used, and a single-color solid (fill) pattern (10 cm×10 cm, an amount of adhesion of toner particles: 1.2 g/m$^2$) of each liquid developer in Examples and Comparative Examples was formed on a recording medium (coated paper) and in succession fixed with a heat roller (180° C.×a nip time of 30 msec.).

Thereafter, a Macbeth reflection density meter (a trade name: "RD918", manufactured by Sakata Inx Eng. Co., Ltd.) was used to measure at 20 locations, density of a recording material (coated paper) on which no print was created, and an average value thereof was defined as a white density. Then, density of the white background image of the 10 prints obtained above was measured at 20 locations, and a value calculated by subtracting the white density measured above from an average density thereof was defined as fog density. Evaluation in three ranks below was made.

A: Fog density being lower than 0.005

B: Fog density being 0.005 or higher and lower than 0.01

C: Fog density being 0.01 or higher

Lower fog density indicates excellent transferability (that is, dissatisfactory transfer being lessened). Table 2 shows results.

<Image Density>

The image formation apparatus shown in FIG. 2 was used, and a single-color solid (fill) pattern (10 cm×10 cm, an amount of adhesion of toner particles: 1.2 g/m$^2$) of each liquid developer in Examples and Comparative Examples was formed on a recording medium (coated paper) and in succession fixed with a heat roller (180° C.×a nip time of 30 msec.).

Thereafter, image density of a black solid portion of the fixed image obtained above was measured with a reflection density meter "X-Rite model 404" (a trade name, manufactured by X-Rite, Incorporated.) and evaluation in two ranks below was made.

A: Image density being 1.7 or higher

B: Image density lower than 1.5

A higher numeric value for image density indicates higher image density. Table 2 shows results.

<Fixability>

The image formation apparatus shown in FIG. 2 was used, and a single-color solid (fill) pattern (10 cm×10 cm, an amount of adhesion of toner particles: 1.2 g/m$^2$) of each liquid developer in Examples and Comparative Examples was formed on a recording medium (coated paper) and in succession fixed with a heat roller (180° C.×a nip time of 40 msec.).

Thereafter, a single-color solid pattern obtained above was rubbed twice with an eraser (a trade name: ink eraser "LION 26111" manufactured by Lion Office Products, Corp.) at pressing load of 1 kgf, a ratio of remaining image density was measured with a reflection density meter "X-Rite model 404" (a trade name, manufactured by X-Rite, Incorporated.), and evaluation in three ranks below was made.

A: Ratio of remaining image density not lower than 90%

B: Ratio of remaining image density not lower than 80% and lower than 90%

C: Ratio of remaining image density lower than 80%

As the ratio of remaining image density is higher, fixation strength of an image is high, which indicates high fixability. Table 2 shows results.

<Color Reproducibility>

The image formation apparatus shown in FIG. 2 was used, and a single-color solid (fill) pattern (10 cm×10 cm, an amount of adhesion of toner particles: 1.2 g/m$^2$) of each liquid developer in Examples and Comparative Examples was formed on a recording medium (coated paper) and in succession fixed with a heat roller (180° C.×a nip time of 30 msec.).

Thereafter, a hue of this single-color solid pattern was evaluated with the use of a colorimeter (a trade name: "CM-3700d" manufactured by Konica Minolta, Inc.). Specifically, color difference ΔE between this single-color solid pattern and Japan Color Color Reproduction Printing 2007 chart defined as the color standard for offset sheet-fed printing (type of paper: coated paper, manner: black single-color solid portion) was calculated, and an average value thereof was calculated. Each average value was evaluated in three ranks below. Color difference ΔE was defined as a square root of the sum of squares of differences on the L* axis, the a* axis, and the b* axis in the uniform color space of the L*a*b* colorimetric system defined under JIS Z 8729.

A: Color difference ΔE being smaller than 3

B: Color difference ΔE being 3 or greater and smaller than 6

C: Color difference ΔE being 6 or greater

Smaller color difference ΔE indicates an excellent hue. Table 2 shows results.

An amount of adhesion of toner particles of each liquid developer in Example 12 and Comparative Example 8 was set to 1.5 g/m$^2$ in each evaluation described above.

TABLE 2

| | Adhesion Amount (g/m$^2$) | Transfer-ability (HH) | Image Density | Color Reproduc-ibility | Fixability (Bond Paper) |
|---|---|---|---|---|---|
| Example 1 | 1.2 | A | A | A | A |
| Example 2 | 1.2 | A | A | A | A |
| Example 3 | 1.2 | A | A | A | A |
| Example 4 | 1.2 | A | A | A | A |
| Example 5 | 1.2 | A | A | A | A |
| Example 6 | 1.2 | A | A | A | A |
| Example 7 | 1.2 | A | A | A | A |
| Example 8 | 1.2 | A | A | B | B |
| Example 9 | 1.2 | A | A | B | B |
| Example 10 | 1.2 | A | A | B | B |
| Example 11 | 1.2 | B | A | B | B |
| Example 12 | 1.5 | A | A | A | A |
| Example 13 | 1.2 | A | A | A | A |
| Comparative Example 1 | 1.2 | C | B | C | A |
| Comparative Example 2 | 1.2 | A | A | C | A |
| Comparative Example 3 | 1.2 | A | B | C | A |
| Comparative Example 4 | 1.2 | A | B | C | A |
| Comparative Example 5 | 1.2 | B | B | C | A |
| Comparative Example 6 | 1.2 | C | B | B | A |
| Comparative Example 7 | 1.2 | C | B | C | C |

TABLE 2-continued

| | Adhesion Amount ($g/m^2$) | Transfer-ability (HH) | Image Density | Color Reproduc-ibility | Fixability (Bond Paper) |
|---|---|---|---|---|---|
| Comparative Example 8 | 1.5 | A | A | C | A |
| Comparative Example 9 | 1.2 | A | A | C | A |

Referring to Table 2, it was found that the liquid developers in Examples 1 to 13 were excellent in all of fixability, transferability, and a hue. "A" in evaluation of an image density presents no practical problem, and "A" or "B in evaluation of fixability, transferability, and a hue presents no practical problem.

[Manufacturing of Dry Developer]

The dry developers according to the present invention were manufactured in Examples 14 to 24 and the dry developers for comparison were manufactured in Comparative Examples 10 to 18. In Examples 14 to 24 and Comparative Examples 10 to 18, two-component dry developers containing toner particles having the core/shell structure were manufactured.

<Preparation of External Additive Particles 1>

Silica particles were fabricated as external additive particles 1through a procedure below, with a sol-gel method.

Initially, in a reaction vessel provided with a stirrer, a dropping funnel, and a thermometer, 625 parts of methanol, 40 parts of water, and 50 parts of 28 mass % ammonia water were introduced, to thereby prepare a methanol-water solvent mixture containing ammonia water.

Thereafter, a temperature of the solvent mixture was adjusted to 35° C., and 800 parts of tetramethoxysilane and 420 parts of 5.4 mass % ammonia water were dropped in the solvent mixture while stirring. Thus, a silica fine particle dispersion liquid was prepared. Drop of these compounds was started simultaneously. Tetramethoxysilane was dropped with 3.5 hours being spent and 5.4 mass % ammonia water was dropped with 5 hours being spent.

Then, after 3 moles of hexamethyldisilazane were added to 1 mole of silica fine particles ($SiO_2$) in the silica fine particle dispersion liquid above, heating to 60° C. and reaction treatment for 3 hours were carried out, so that hydrophobization treatment of the silica fine particles was carried out. After hydrophobization treatment, the solvent mixture was distilled out under a reduced pressure, so that hydrophobic silica particles (external additive particles 1) having a number average primary particle size of 50 nm were obtained.

<Preparation of External Additive Particles 2>

Commercially available metal oxide particles (a number average primary particle size of 7 nm, a BET value of 300, silica particles subjected to hydrophobization treatment with hexamethyldisilazane) were prepared.

<Preparation of Resin-Coated Carrier>

The resin-coated carrier was fabricated through a procedure below. Initially, ferrite particles (a commercially available product) having a volume average particle size of 35 μm were prepared as core material particles. These ferrite particles had a manganese content of 21.0 mol % in MnO equivalent, a magnesium content of 3.3 mol % in MgO equivalent, a strontium content of 0.7 mol % in SrO equivalent, and an iron content of 75.0 mol % in $Fe_2O_3$ equivalent. A volume average particle size was measured with a commercially available laser diffraction type particle size distribution analyzer (a trade name: "HELOS", manufactured by Sympatec GmbH) provided with a wet disperser, and it is consistent with a median diameter D50 described above.

Resin particles for a resin layer were fabricated as follows. Initially, in a reaction vessel to which a stirrer, a temperature sensor, a cooling pipe, and a nitrogen introduction apparatus were attached, a surfactant aqueous solution in which 1.7 part of sodium dodecyl sulfate had been dissolved in 3000 parts of ion exchanged water was introduced. While this surfactant aqueous solution was stirred at a stirring speed of 230 rpm under a nitrogen current, an inside temperature was raised to 80° C. An initiator solution in which 10 parts by mass of potassium persulfate (KPS) had been dissolved in 400 parts of ion exchanged water was added to this surfactant aqueous solution, a liquid temperature was set to 80° C., and a monomer liquid mixture composed of compounds below was dropped with 2 hours being spent:

400 parts of cyclohexyl methacrylate; and 400 parts of methyl methacrylate.

After dropping ended, heating and stirring were performed for 2 hours at a temperature of 80° C. and polymerization reaction was carried out. Thus, a dispersion liquid in which resin particles for coating had been dispersed was fabricated. This dispersion liquid was subjected to drying treatment with a spray dryer to thereby fabricate the resin particles.

Then, 3000 parts of ferrite particles and 120 parts of the resin particles were introduced in a carrier apparatus of a carrier horizontal rotary blade, a peripheral speed of a horizontal rotary blade was set to 4 m/second, and mixing and stirring were carried out for 15 minutes at a temperature of 22° C. Thereafter, stirring treatment was performed for 40 minutes in a state heated to 120° C., to thereby fabricate the resin-coated carrier having a volume average particle size of 38 μm.

Example 14

Toner base particles were fabricated by performing the steps in (1) to (10) described above, and a two-component dry developer was manufactured by performing the step in (11) above. Each step performed in the present Example 14 will specifically be described below.

(1) Step of Fabrication of a Dispersion Liquid for Core Resin

In a reaction vessel to which a stirrer, a temperature sensor, a temperature controller, a cooling pipe, and a nitrogen introduction apparatus were attached, 2 parts of sodium lauryl sulfate which was an anionic surfactant and 2900 parts of ion exchanged water were introduced, to thereby fabricate a surfactant aqueous solution. A temperature was raised to 80° C. while the surfactant aqueous solution was stirred at a stirring speed of 230 rpm under a nitrogen current.

After temperature increase, an initiator solution in which 9 parts of potassium persulfate (KPS) had been dissolved in 200 parts of ion exchanged water was added, a liquid temperature of the surfactant aqueous solution above was set to 78° C., and a monomer liquid mixture containing compounds below was dropped with 3 hours being spent:

540 parts of styrene;

270 parts of n-butyl acrylate; and 65 parts of methacrylic acid.

After dropping ended, heating and stirring for 1 hour at 78° C. were performed to cause polymerization reaction (first-step polymerization), so that a dispersion liquid of "resin fine particles A1" was fabricated.

Then, a monomer liquid mixture composed of compounds below was subjected to mixing and dispersion treatment for 1 hour with a mechanical dispersion machine having a circulation path (a trade name: "Clearmix" manufactured by M Technique Co., Ltd.). Thus, an "emulsified dispersion liquid B1" containing emulsified particles was fabricated. Pentaerythritol tetrabehenate which was a wax having an ester bond was added after three monomers below and n-octyl mercaptan which was a chain transfer agent had been dissolved, and dissolved through temperature increase to 85° C.

94 parts of styrene,
60 parts of n-butyl acrylate,
11 parts of methacrylic acid,
5 parts of n-octyl mercaptan, and
51 parts of pentaerythritol tetrabehenate Then, in a reaction vessel to which a stirrer, a temperature sensor, a temperature controller, a cooling pipe, and a nitrogen introduction apparatus were attached, 1100 parts of ion exchanged water and 2 parts of sodium lauryl sulfate were introduced, to thereby fabricate a surfactant aqueous solution, and a temperature thereof was raised to 90° C. After temperature increase, 28 parts in solid content equivalent of "resin fine particles A1" were added to this surfactant aqueous solution, and after a liquid temperature was set to 80° C., 220 parts of "emulsified dispersion liquid B1" were added. To this solution, an initiator solution in which 2.5 parts of potassium persulfate (KPS) had been dissolved in 110 parts of ion exchanged water was added, heating and stirring was carried out for 2 hours at a temperature of 90° C. to cause polymerization reaction (second-step polymerization), and a dispersion liquid of "resin fine particles A2" was fabricated.

Then, an initiator solution in which 2.5 parts of potassium persulfate (KPS) had been dissolved in 110 parts of ion exchanged water was added to the dispersion liquid of "resin fine particles A2" above, a liquid temperature was set to 80° C., and a monomer liquid mixture containing compounds below was dropped with 1 hour being spent:

230 parts of styrene;
100 parts n-butyl acrylate; and
13 parts of n-octyl mercaptan.

After dropping ended, heating and stirring for 3 hours at a temperature of 80° C. were carried out to thereby cause polymerization reaction (third-step polymerization). Thereafter, cooling to 28° C. was carried out to thereby fabricate a dispersion liquid of "resin particles for cores A" as a core resin dispersion liquid in which core resin particles had been dispersed. These "resin particles for core A" were made of a styrene acrylic copolymer formed by setting a mass ratio of n-butyl acrylate which was a polymeric monomer having an ester bond to 31 mass %, and had a glass transition point of 43° C.

(2) Step of Fabrication of a Coloring Agent Dispersion Liquid

While a solution in which 90 parts of sodium dodecyl sulfate had been dissolved in 1600 parts of ion exchanged water was stirred, 171 parts of carbon black (a trade name: "Mogul L" manufactured by Cabot Corporation), 43 parts of C. I. Pigment Violet 23 (a trade name: "Cromophtal® Violet D 5800" manufactured by Clariant Japan K. K.), and 71 parts of C. I. Pigment Brown 23 (a trade name: "Cromophtal® Brown 5R" manufactured by BASF) were gradually added.

Then, dispersion treatment was performed with a stirrer (a trade name: "Clearmix" manufactured by M Technique Co., Ltd.) so as to prepare a "coloring agent fine particle dispersion liquid C1" as a coloring agent dispersion liquid. A particle size of the coloring agent particles contained in this coloring agent fine particle dispersion liquid C1 was measured with a Microtrac particle size distribution measurement apparatus (a trade name: "UPA-150" manufactured by Nikkiso Co., Ltd.) and it was 126 nm.

(3) Step of Aggregation and Fusion of Core Resin (Step of Fabricating Core Particles)

In a reaction vessel to which a stirrer, a temperature sensor, a cooling pipe, and a nitrogen introduction apparatus were attached, 288 parts (in solid content equivalent) of the dispersion liquid of "resin particles for cores A," 1500 parts of ion exchanged water, and 40 parts (in solid content equivalent) of coloring agent fine particle dispersion liquid C1 were introduced. In addition, a dispersion stabilizer solution in which 3 parts of polyoxyethylene-2-dodecyl ether sodium sulfate had been dissolved in 120 parts of ion exchanged water was added to the reaction vessel and a liquid temperature was set to 30° C. Thereafter, 5 moles/liter of a sodium hydroxide aqueous solution was added to adjust pH to 10.

Then, a flocculating agent aqueous solution in which 35 parts of magnesium chloride.hexahydrate had been dissolved in 35 parts of ion exchanged water was added with 10 minutes being spent at 30° C. in a stirred state, and held for 3 minutes after addition. Then, temperature increase was started. Temperature was increased up to 90° C. with 60 minutes being spent, and resin particles for cores A and the coloring agent fine particles were aggregated and simultaneously fused while they are held at 90° C.

(4) First Aging Step

Following the step of aggregation and fusion, a reaction system containing the core particles constituted of the core resin particles and the coloring agent particles was held at 90° C. Then, a particle size distribution analyzer (a trade name: "Multisizer 3" manufactured by Beckman Coulter) was used at any time to measure a particle size of the aggregated particles grown in the reaction vessel. When a volume average particle size attained to 5.4 μm, the next step of forming a shell was performed.

(5) Step of Forming a Shell

Following the first aging step above, 72 parts (in solid content equivalent) of a dispersion liquid of "shell resin particles B" were added at the time when a volume average particle size of the aggregated particles attained to 5.4 μm, and heating and stirring were continued until shell resin particles B adhered to the surfaces of the aggregated particles. Then, at any time, a small amount of reaction solution was taken out and centrifuged. At the time point when a supernatant was transparent, an aqueous solution in which 150 parts of sodium chloride had been dissolved in 600 parts of ion exchanged water was added to stop growth of the particles.

Shell resin particles B used in the present step were particles of a styrene acrylic modified polyester resin in which a styrene acrylic copolymer molecular chain had molecularly been bonded to a terminal of a polyester molecular chain, and a dispersion liquid of these shell resin particles B was prepared as follows.

Namely, in a reaction vessel to which a nitrogen introduction apparatus, a dewatering pipe, a stirrer, and a thermocouple were attached, 500 parts of a 2-mole adduct of propylene oxide to bisphenol A, 154 parts of terephthalic acid, 45 parts of fumaric acid, and 2 parts of tin octylate were introduced, and polycondensation reaction for 8 hours at a temperature of 230° C. was carried out. After polycondensation reaction was further continued for 1 hour at 8 kPa, cooling to 160° C. was carried out. Polyester molecules were thus formed.

Then, 10 parts of acrylic acid were further mixed in the reaction system containing the polyester molecules at a temperature of 160° C. and held for 15 minutes. Thereafter, a liquid mixture composed of compounds below was dropped through a dropping funnel with 1 hour being spent:

142 parts by mass of styrene;

35 parts by mass of n-butyl acrylate; and 10 parts by mass of a polymerization initiator (di-t-butyl peroxide).

After dropping ended, addition polymerization reaction was carried out for 1 hour while a temperature of 160° C. was maintained, and thereafter a temperature was raised to 200° C. and held for 1 hour at 10 kPa. Thus, a "styrene acrylic modified polyester resin B1" in which a content of styrene acrylic copolymer molecular chain was 20 mass % was fabricated.

Then, 100 parts of "styrene acrylic modified polyester resin B1" were subjected to crushing treatment with a commercially available crushing treatment apparatus (a trade name: "Roundel Mill", model: RM, manufactured by Tokuju Co., Ltd."). In succession, the resultant product was mixed with 638 parts of a sodium lauryl sulfate solution fabricated in advance (a concentration of 0.26 mass %) and subjected to ultrasonic dispersion treatment for 30 minutes at V-LEVEL and 300 μA with the use of an ultrasonic homogenizer (a trade name: "US-150T, manufactured by Nippon Seiki Co., Ltd.) while stirring treatment was performed. Thus, a dispersion liquid of "resin particles for shells B" having a volume average particle size of 250 nm was fabricated.

(6) Second Aging Step

Then, following the step of forming a shell, heating and stirring were carried out at a temperature of 90° C., so that growth of the particles proceeded. In this state, fusion of the particles was caused to proceed until average circularity attained to 0.965 in measurement with a particle image analyzer (a trade name: "FPIA-2100" manufactured by Sysmex Corporation).

(7) Cooling Step

Thereafter, a liquid temperature was lowered to 30° C., pH of the reaction system was adjusted to 2 with the use of hydrochloric acid, and stirring was stopped. A dispersion liquid in which toner base particles having the core/shell structure had been dispersed was thus prepared.

(8) Cleaning Step

Then, the dispersion liquid of the toner base particles was subjected to solid-liquid separation in a basket type centrifuge (a trade name: "MARK III", model number: 60×40, manufactured by Matsumoto Machine Sales Co., Ltd.), and a wet cake of the toner base particles was formed. Then, this wet cake was subjected to cleaning treatment with ion exchanged water at 45° C. in the basket type centrifuge, until electrical conductivity of a filtrate attained to 5 μS/cm.

(9) Drying Step

Then, the toner base particles subjected to cleaning treatment were transferred to a dryer (a trade name: "Flash Jet Dryer" manufactured by Seishin Enterprise Co., Ltd.), and drying treatment was performed until an amount of moisture attained to 0.5 mass %.

By performing the steps in (1) to (9) above, the toner base particles having a volume average particle size of 5.7 μm were fabricated. The toner base particles were fabricated by adding 288 parts in solid content equivalent of the dispersion liquid of resin particles for cores A, 40 parts in solid content equivalent of coloring agent fine particle dispersion liquid C1, and 72 parts in solid content equivalent of the dispersion liquid of resin particles for shells B. Therefore, the total content of the coloring agents in the toner particles (toner base particles) is 10 mass %. The volume average particle size of the toner base particles was measured with a particle size distribution measurement apparatus "Multisizer III".

(10) Step of Treatment with an External Additive

Then, 1.0 part of external additive particles 1 and 1.5 part of external additive particles 2 were added to 100 parts of the toner base particles subjected to drying treatment, and external additive treatment was performed with a peripheral speed of a stirring vane of a Henschel mixer (a trade name: "FM10B", manufactured by Mitsui Miike Chemical Engineering Machinery Co., Ltd.), a treatment temperature, and a treatment time period being set to 40 m/second, 30° C., and 20 minutes, respectively. After external additive treatment was performed, a sieve of 90-μm mesh was used to remove coarse particles, to thereby fabricate external additive-treated toner particles.

(11) Mixing Step

Then, the dry developer in Example 14 was prepared by using the external additive-treated toner particles and the resin-coated carrier such that a concentration of toner particles contained in the developer was 7.0 mass %. Specifically, 7 parts of the external additive-treated toner particles were blended to 100 parts of the resin-coated carrier, and treatment was performed in an environment at a room temperature and a normal humidity (20° C., 50% RH) with the use of a V blender at the number of revolutions of 20 rpm, with a time period for stirring being set to 20 minutes. Thereafter, the mixture was sieved through a sieve of 125-μm mesh and particles which passed through the sieve were adopted as the dry developer.

Examples 15 to 24 and Comparative Examples 10 to 18

The dry developers according to Examples 15 to 24 and Comparative Examples 10 to 18 were fabricated with the method the same as in Example 1 except for fabricating coloring agent fine particle dispersion liquids C2 to C20 as in Example 14 except that a type of carbon black (the first coloring agent), an amount of addition of carbon black, a type of a coloring agent (the second coloring agent, the third coloring agent, and other coloring agents), and an amount of addition of each coloring agent were as shown in Table 3. Table 4 shows a ratio of blended each component in the dry developer.

A volume average particle size of toner base particles of each dry developer in Examples 14 to 24 and Comparative Examples 10 to 18 was measured with a particle size distribution measurement apparatus (a trade name: "FPIA-2100" manufactured by Sysmex Corporation) and it was from 5.5 to 5.8 μm.

TABLE 3

| | | First Coloring Agent | | Second Coloring Agent | | Third Coloring Agent | | Other Coloring Agents | |
|---|---|---|---|---|---|---|---|---|---|
| | | Type | Amount | Type | Amount | Type | Amount | Type | Amount |
| Example 14 | C1 | CB1 | 171 | V1 | 43 | BR1 | 71 | — | — |
| Example 15 | C2 | CB1 | 155 | V2 | 70 | BR2 | 60 | — | — |
| Example 16 | C3 | CB1 | 177 | V1 | 23 | BR2 | 86 | — | — |
| Example 17 | C4 | CB1 | 157 | V2 | 43 | BR1 | 86 | — | — |
| Example 18 | C5 | CB1 | 157 | V1 | 43 | BR2 | 71 | M1 | 14 |
| Example 19 | C6 | CB1 | 163 | V1 | 39 | BR2 | 83 | — | — |
| Example 20 | C7 | CB1 | 180 | V2 | 43 | BR2 | 63 | — | — |
| Example 21 | C8 | CB1 | 171 | V1 | 43 | BR2 | 71 | — | — |
| Example 22 | C9 | CB1 | 171 | V2 | 48 | BR1 | 66 | — | — |
| Example 23 | C10 | CB2 | 157 | V1 | 43 | BR1 | 86 | — | — |
| Example 24 | C11 | CB2 | 157 | V2 | 43 | BR1 | 86 | — | — |
| Comparative Example 10 | C12 | CB1 | 171 | V1 | 43 | — | — | — | 71 |
| Comparative Example 11 | C13 | CB1 | 171 | — | — | BR1 | 114 | C1 | — |
| Comparative Example 12 | C14 | CB1 | 171 | V1 | 114 | — | — | — | — |
| Comparative Example 13 | C15 | CB1 | 171 | V2 | 114 | — | — | — | — |
| Comparative Example 14 | C16 | — | — | V1 | 114 | BR1 | 171 | — | — |
| Comparative Example 15 | C17 | CB1 | 171 | — | — | BR1 | 71 | C1 | 43 |
| Comparative Example 16 | C18 | CB1 | 171 | V3 | 43 | BR1 | 71 | — | — |
| Comparative Example 17 | C19 | CB1 | 171 | V1 | 20 | BR1 | 94 | — | — |
| Comparative Example 18 | C20 | CB1 | 171 | V1 | 71 | BR1 | 43 | — | — |

TABLE 4

| | First Coloring Agent | | | Second Coloring Agent | | Third Coloring Agent | | Other Coloring Agents | | Ratio of Second | Total Amount of Coloring |
|---|---|---|---|---|---|---|---|---|---|---|---|
| | Type | pH | Amount (wt %) | Type | Amount (wt %) | Type | Amount (wt %) | Type | Amount (wt %) | Coloring Agent | Agents (wt %) |
| Example 14 | CB1 | 5.8 | 6.0 | V1 | 1.5 | BR1 | 2.5 | — | — | 15.0 | 10 |
| Example 15 | CB1 | 5.8 | 6.0 | V2 | 2.7 | BR2 | 2.3 | — | — | 24.5 | 11 |
| Example 16 | CB1 | 5.8 | 6.2 | V1 | 0.8 | BR2 | 3.0 | — | — | 8.0 | 10 |
| Example 17 | CB1 | 5.8 | 5.5 | V2 | 1.5 | BR1 | 3.0 | — | — | 15.0 | 10 |
| Example 18 | CB1 | 5.8 | 5.5 | V1 | 1.5 | BR2 | 2.5 | M1 | 0.5 | 15.0 | 10 |
| Example 19 | CB1 | 5.8 | 6.3 | V1 | 1.5 | BR2 | 3.2 | — | — | 13.6 | 11 |
| Example 20 | CB1 | 5.8 | 6.3 | V2 | 1.5 | BR2 | 2.2 | — | — | 15.0 | 10 |
| Example 21 | CB1 | 5.8 | 6.0 | V1 | 1.5 | BR1 | 2.5 | — | — | 15.0 | 10 |
| Example 22 | CB1 | 5.8 | 6.0 | V2 | 1.7 | BR1 | 2.3 | — | — | 17.0 | 10 |
| Example 23 | CB2 | 7.6 | 5.5 | V1 | 1.5 | BR1 | 3.0 | — | — | 15.0 | 10 |
| Example 24 | CB2 | 7.6 | 5.5 | V2 | 1.5 | BR1 | 3.0 | — | — | 15.0 | 10 |
| Comparative Example 10 | CB1 | 5.8 | 6.0 | V1 | 1.5 | — | — | C1 | 2.5 | 15.0 | 10 |
| Comparative Example 11 | CB1 | 5.8 | 6.0 | — | — | BR1 | 4.0 | — | — | — | 10 |
| Comparative Example 12 | CB1 | 5.8 | 6.0 | V1 | 4.0 | — | — | — | — | 40.0 | 10 |
| Comparative Example 13 | CB1 | 5.8 | 6.0 | V2 | 4.0 | — | — | — | — | 40.0 | 10 |
| Comparative Example 14 | — | — | — | V1 | 4.0 | BR1 | 6.0 | — | — | 40.0 | 10 |
| Comparative Example 15 | CB1 | 5.8 | 6.0 | — | — | BR1 | 2.5 | C1 | 1.5 | — | 10 |
| Comparative Example 16 | CB1 | 5.8 | 6.0 | V3 | 1.5 | BR1 | 2.5 | — | — | 15.0 | 10 |
| Comparative Example 17 | CB1 | 5.8 | 6.0 | V1 | 0.7 | BR1 | 3.3 | — | — | 7.0 | 10 |
| Comparative Example 18 | CB1 | 5.8 | 6.0 | V1 | 2.5 | BR1 | 1.5 | — | — | 25.0 | 10 |

Various signs in Tables 3 and 4 represent the same meaning as in Table 1. The "ratio of second coloring agent" in Table 4 represents a ratio (mass %) of the second coloring agent with respect to the total amount of the coloring agents contained in the toner particles, and the "total amount of coloring agents" represent a ratio (mass %) of the total amount of the coloring agents with respect to a mass of the toner particles.

[Evaluation of Characteristics of Dry Developer]

An image was formed with the image formation apparatus shown in FIG. 1 in connection with each dry developer in Examples 14 to 24 and Comparative Examples 10 to 18, and transferability, an image density, fixability, and color reproducibility of each image were evaluated.

<Process and Process Condition of Image Formation Apparatus>

A commercially available multi function peripheral corresponding to the image formation apparatus shown in FIG. 1 (a trade name: bizhub PRO C6500 manufactured by Konica Minolta Business Technologies, Inc.) was used, each dry developer in Examples 14 to 24 and Comparative Examples 10 to 18 was used as black toner in an environment where a temperature was 35° C. and a relative humidity was 65% RH, and images were created by making 2000 continuous prints for each dry developer without using toner of other colors.

An image created in continuous prints was such that an image of a photography of a person's face, a halftone image having relative reflection density of 0.4, a white background image, and a solid image having relative reflection density of 1.3 were output in quarters on a recording medium (coated paper) of A4 size. It is noted that relative reflection density of the halftone image and the solid image was represented as a measurement value with the use of a Macbeth reflection density meter (a trade name: "RD918" manufactured by Sakata Inx Eng. Co., Ltd.).

Then, at the end of making of 2000 continuous prints, an image shown in FIG. 3 was continuously printed on 10 sheets such that an amount of adhesion on the recording medium (coated paper) was 4.5 g/m$^2$, which were in turn used for evaluation. Details of the process are as described above and process conditions are as follows.

System Speed: 40 cm/s

Photoconductor: Negatively charged OPC

Charge Potential: −700 V

Development Voltage (Voltage Applied to Development Roller): −450 V

Primary Transfer Voltage (Voltage Applied to Transfer Roller): +600 V

Secondary Transfer Voltage: +1200 V

Pre-Development Corona CHG: Adjusted as appropriate between −3 and 5 kV of needle application voltage <Evaluation of Characteristics>

A method of evaluating transferability, an image density, fixability, and color reproducibility was the same as that for the liquid developer. Table 5 shows results.

TABLE 5

| | Amount of Adhesion (g/m$^2$) | Transfer-ability (HH) | Image Density | Color Reproduc-ibility | Fixability (Bond Paper) |
|---|---|---|---|---|---|
| Example 14 | 4.5 | A | A | A | A |
| Example 15 | 4.5 | A | A | A | A |
| Example 16 | 4.5 | A | A | A | A |
| Example 17 | 4.5 | A | A | A | A |
| Example 18 | 4.5 | A | A | A | A |

TABLE 5-continued

| | Amount of Adhesion (g/m$^2$) | Transfer-ability (HH) | Image Density | Color Reproduc-ibility | Fixability (Bond Paper) |
|---|---|---|---|---|---|
| Example 19 | 4.5 | A | A | A | A |
| Example 20 | 4.5 | A | A | A | A |
| Example 21 | 4.5 | A | A | B | B |
| Example 22 | 4.5 | A | A | B | B |
| Example 23 | 4.5 | A | A | B | B |
| Example 24 | 4.5 | B | A | B | B |
| Comparative Example 10 | 4.5 | C | B | C | A |
| Comparative Example 11 | 4.5 | A | A | C | A |
| Comparative Example 12 | 4.5 | A | B | C | A |
| Comparative Example 13 | 4.5 | A | B | C | A |
| Comparative Example 14 | 4.5 | B | B | C | A |
| Comparative Example 15 | 4.5 | C | B | B | A |
| Comparative Example 16 | 4.5 | C | B | C | C |
| Comparative Example 17 | 4.5 | A | A | C | A |
| Comparative Example 18 | 4.5 | A | A | C | A |

Referring to Table 5, it was found that the dry developers in Examples 14 to 24 were excellent in all of fixability, transferability, and a hue. "A" in evaluation of an image density presents no practical problem, and "A" or "B in evaluation of fixability, transferability, and a hue presents no practical problem.

Though the embodiment and the examples of the present invention have been described above, combination of features in each embodiment and example described above as appropriate is also originally intended.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A developer for electrostatic latent image, comprising toner particles, said toner particles containing a resin and a coloring agent, said coloring agent consisting of a first coloring agent, a second coloring agent, and a third coloring agent, said first coloring agent being carbon black, said second coloring, agent being one or more of C. I. Pigment Violet 19 and C. I. Pigment Violet 23, said third coloring agent being one or more of C. I. Pigment Brown 23 and C. I. Pigment Brown 25, a content of said first coloring agent being not lower than 40 mass % and not higher than 65 mass % with respect, to a total amount of said coloring agents, a content of said second coloring agent being not lower than 8 mass % and not higher than 25 mass % with respect to the total amount of said coloring agents, and a content of said third coloring agent being not lower than 20 mass % and not higher than 35 mass % with respect to a total amount of said coloring agents, said resin being a polyester resin having an acid value of not lower than 5 mg KOH/g and not higher than 20 mg KOH/g.

2. The developer for electrostatic latent image according to claim 1, wherein said carbon black is acid carbon black.

3. The developer for electrostatic latent image according to claim 1, being a liquid developer in which said toner particles are dispersed in an insulating liquid, wherein a content of said coloring agents in said toner particles is not lower than 20 mass % and not higher than 40 mass %.

4. The developer for electrostatic latent image according to claim 1, the content of said first coloring agent being not lower than 45 mass % and not higher than 60 mass % with respect to the total amount of said coloring agents.

5. The developer for electrostatic latent image according to claim 4, the content of said first coloring agent being not lower than 45 mass % and not higher than 55 mass % with respect to the total amount of said coloring agents.

6. The developer for electrostatic latent image according to claim 1, wherein a mass ratio of said third coloring agent to said second coloring agent is 4:1 to 1:1.

* * * * *